US008955846B2

(12) United States Patent
Frickey

(10) Patent No.: US 8,955,846 B2
(45) Date of Patent: Feb. 17, 2015

(54) ARTICULATED TARGET STAND WITH MULTIPLE DEGREES OF ADJUSTMENT

(76) Inventor: Steven Jay Frickey, Boise, ID (US)

( * ) Notice: Subject to any disclaimer, the term of this patent is extended or adjusted under 35 U.S.C. 154(b) by 178 days.

(21) Appl. No.: 13/494,938

(22) Filed: Jun. 12, 2012

(65) Prior Publication Data

US 2012/0313324 A1 Dec. 13, 2012

Related U.S. Application Data

(60) Provisional application No. 61/496,563, filed on Jun. 13, 2011.

(51) Int. Cl.
*F41J 1/10* (2006.01)
*F16M 11/12* (2006.01)

(52) U.S. Cl.
CPC ..... *F41J 1/10* (2013.01)
USPC ..... 273/407; 248/183.1

(58) Field of Classification Search
USPC ..... 273/390–392, 403–410; 248/431, 166, 248/167, 434, 435, 168, 169–173, 436, 439, 248/183.1, 184.1, 184.2, 186.1, 186.2
See application file for complete search history.

(56) References Cited

U.S. PATENT DOCUMENTS

| | | | | | |
|---|---|---|---|---|---|
| 2,069,822 | A | | 2/1937 | Douglas | |
| 2,538,118 | A | * | 1/1951 | Miller | 273/407 |
| 2,899,204 | A | | 8/1959 | Ratay | |
| 2,990,618 | A | * | 7/1961 | Petree et al. | 33/280 |
| 3,080,166 | A | * | 3/1963 | Clark | 273/407 |
| 3,087,701 | A | | 4/1963 | Wallace | |
| 3,415,519 | A | | 12/1968 | Hand | |
| 3,601,353 | A | | 8/1971 | Dale | |
| 4,029,318 | A | | 6/1977 | Boss | |
| 4,234,149 | A | * | 11/1980 | Kawazoe | 248/184.1 |
| 4,288,080 | A | * | 9/1981 | Laporte et al. | 273/406 |
| 4,625,974 | A | * | 12/1986 | Andrews | 273/407 |
| 4,691,925 | A | | 9/1987 | Scholem | |
| 4,726,593 | A | | 2/1988 | Wade | |
| 5,067,683 | A | | 11/1991 | Wagner | |
| D329,665 | S | | 9/1992 | Carroll | |
| 5,145,133 | A | * | 9/1992 | France | 248/168 |
| 5,503,356 | A | | 4/1996 | Shelby | |
| 5,598,996 | A | | 2/1997 | Rath | |
| 5,671,924 | A | | 9/1997 | Scott | |
| 5,678,824 | A | | 10/1997 | Fortier et al. | |
| D388,128 | S | | 12/1997 | Young | |
| 5,829,753 | A | * | 11/1998 | Wiser | 273/407 |
| 5,937,881 | A | | 8/1999 | Villa | |
| 5,938,203 | A | | 8/1999 | Beckwith, Sr. | |

(Continued)

*Primary Examiner* — Mark Graham

(57) ABSTRACT

One embodiment of an articulated target stand having a base consisting of radially symmetrical legs extending out from a central hub wherein the legs are splayed, optimally forming a three point stance in the deployed position, or folded vertically about the axis of the central hub when in the collapsed position. Pivotally connected atop the base central hub is a three axis yoke gimbal assembly providing selectively rotatable adjustments about the axes. Pivotally connected atop the yoke gimbal assembly is a further assembly providing the means by which the operator can attach commonly available, expendable type targets and target support members. The articulated target stand formed by this embodiment provides a means by which the target can be positioned about four axis of adjustment with respect to the stand's base on a variety of terrains, for a variety of target presentations and is collapsible to an easy carry configuration.

9 Claims, 14 Drawing Sheets

(56) References Cited

U.S. PATENT DOCUMENTS

| | | | | |
|---|---|---|---|---|
| 5,967,523 | A * | 10/1999 | Brownlee | 273/407 |
| D424,652 | S | 5/2000 | Minneman | |
| 6,305,117 | B1 | 10/2001 | Hales, Sr. | |
| 6,435,512 | B1 | 8/2002 | Beckwith, Sr. | |
| 6,491,303 | B1 | 12/2002 | Huston | |
| 6,726,208 | B2 | 4/2004 | Wilkus | |
| 7,273,198 | B2 | 9/2007 | Tourtellotte et al. | |
| 7,350,785 | B2 | 4/2008 | Lewis | |
| 7,422,216 | B1 | 9/2008 | Underhill | |
| 7,427,069 | B2 | 9/2008 | Bateman et al. | |
| 7,431,302 | B2 | 10/2008 | Bassett et al. | |
| 7,434,810 | B2 | 10/2008 | DeMille et al. | |
| 7,497,441 | B2 | 3/2009 | Marshall et al. | |
| D600,482 | S | 9/2009 | St. John | |
| 7,644,927 | B2 | 1/2010 | Law | |
| 7,681,887 | B2 | 3/2010 | Hensley | |
| 7,712,743 | B1 | 5/2010 | Miller | |
| 7,726,657 | B2 | 6/2010 | Shalosky | |
| 7,784,794 | B2 | 8/2010 | Sitton | |
| 7,845,646 | B1 | 12/2010 | Weber | |
| 7,896,299 | B2 | 3/2011 | Chinuki et al. | |
| 8,505,921 | B2 * | 8/2013 | Amodt | 273/407 |
| 2002/0130230 | A1 * | 9/2002 | Ursan et al. | 248/184.1 |
| 2003/0168813 | A1 * | 9/2003 | Wilkus | 273/407 |
| 2005/0077441 | A1 | 4/2005 | Coverstone et al. | |
| 2006/0284035 | A1 | 12/2006 | Crosby | |
| 2007/0024006 | A1 | 2/2007 | Marshall et al. | |
| 2008/0265511 | A1 * | 10/2008 | Shum | 273/392 |
| 2009/0014961 | A1 | 1/2009 | Bateman et al. | |
| 2009/0065665 | A1 * | 3/2009 | Yoshino et al. | 248/171 |
| 2009/0256314 | A1 * | 10/2009 | Kobett | 273/407 |
| 2010/0194048 | A1 | 8/2010 | Medina et al. | |
| 2010/0225063 | A1 | 9/2010 | Wyrick et al. | |
| 2011/0074112 | A1 | 3/2011 | Allen | |
| 2011/0127723 | A1 | 6/2011 | Haynes | |
| 2011/0204571 | A1 * | 8/2011 | Duerr | 273/407 |

* cited by examiner

ARTICULATED TARGET STAND WITH MULTIPLE DEGREES OF ADJUSTMENT

CROSS-REFERENCE TO RELATED APPLICATIONS

The present application claims the benefit of U.S. Provisional Application No. 61/496,563, filed Jun. 13, 2011, by the present inventor.

FEDERALLY SPONSORED RESEARCH none.

SEQUENCE LISTING OR PROGRAM none.

BACKGROUND

Prior Art—The following is a tabulation of prior art that appears relevant:

U.S. Patents

| Patent Number | Kind Code | Issue Date | Patentee | Title |
|---|---|---|---|---|
| 7,896,299 | B2 | 2011 Mar. 01 | Chinuki et al. | Support Stand |
| 7,845,646 | B1 | 2010 Dec. 07 | Weber | Practice Targeting System and Method of Use Thereof |
| 7,784,794 | B2 | 2010 Aug. 31 | Sitton | Paper Archery Tuner |
| 7,726,657 | B2 | 2010 Jun. 01 | Shalosky | Target Stand System |
| 7,712,743 | B1 | 2010 May 11 | Miller | Three Dimensional Reactionary Turkey Target |
| 7,681,887 | B2 | 2010 Mar. 23 | Hensley | Target Hanger And Target Support System |
| 7,644,927 | B2 | 2010 Jan. 12 | Law | Target Support System |
| D600482 | S | 2009 Sep. 22 | St. John | Archery Target Stand |
| 7,497,441 | B2 | 2009 Mar. 03 | Marshall et al. | Adjustable Target Mount |
| 7,434,810 | B2 | 2008 Oct. 14 | DeMille et al. | Airgun Range |
| 7,431,302 | B2 | 2008 Oct. 07 | Bassett et al. | Modular ballistic wall and target system |
| 7,427,069 | B2 | 2008 Sep. 23 | Bateman et al. | Folding Target Stand |
| 7,422,216 | B1 | 2008 Sep. 09 | Underhill | Target Device |
| 7,350,785 | B2 | 2008 Apr. 01 | Lewis | Test-Cutting Target for Edged-Weapons Practice |
| 7,273,198 | B2 | 2007 Sep. 25 | Tourtellotte et al. | Support Stand Assembly and Method |
| 6,491,303 | B1 | 2002 Dec. 10 | Huston | Portable Target |
| 6,726,208 | B2 | 2004 Apr. 27 | Wilkus | Stand For Targets |
| 6,435,512 | B2 | 2002 Aug. 20 | Beckwith, Sr. | Portable Target Stand and Target |
| 6,305,117 | B1 | 2001 Oct. 23 | Hales, Sr. | Support For Rifle Sighting |
| D424652 | | 2000 May 09 | Minneman | Target Stand |
| 5,938,203 | | 1999 Aug. 17 | Beckwith, Sr. | Portable Target Stand and Target |
| 5,937,881 | | 1999 Aug. 17 | Villa | Adjustable Shadow Casting Shade Umbrella and Stand |
| D388128 | | 1997 Dec. 23 | Young | Combined Multiple Sheet Target Practice Board with Stand |
| 5,678,824 | | 1997 Oct. 21 | Fortier et al. | Portable Target Stand |
| 5,671,924 | | 1997 Sep. 30 | Scott | Portable Target Stand |
| 5,598,996 | | 1997 Feb. 04 | Rath | Adjustable Target Stand |
| 5,503,356 | | 1996 Apr. 02 | Shelby | Folding Target Stand |
| D329665 | | 1992 Sep. 22 | Carroll | Combined Stand and Target For Shooting |
| 5,067,683 | | 1991 Nov. 26 | Wagner | Portable Target Holder |
| 4,726,593 | | 1988 Feb. 23 | Wade | Portable Target Assembly |
| 4,691,925 | | 1987 Sep. 08 | Scholem | Portable Steel Target For Pistol Shooting |
| 3,415,519 | | 1968 Dec. 10 | Hand | Portable Target Holder |
| 3,087,701 | | 1963 Apr. 30 | Wallace | Leg Mounting for Target Frames and the like |
| 2,899,204 | | 1959 Aug. 11 | Ratay | Portable Target Stand |
| 2,069,822 | | 1937 Feb. 09 | Douglas | Target Structure |

U.S. Patent Application Publications

| Patent Number | Kind Code | Issue Date | Patentee | Title |
|---|---|---|---|---|
| 2011/0127723 | A1 | 2011 May 02 | Haynes | Marksman Target Stand |
| 2011/0074112 | A1 | 2011 Mar. 31 | Allen | Target Positioning System |
| 2010/0225063 | B1 | 2010 Sep. 09 | Wyrick et al. | Submachine Gun Target System |
| 2010/0194048 | B2 | 2010 Aug. 05 | Medina et al. | Adjustable Target Stand |
| 2009/0014961 | A1 | 2009 Jan. 15 | Bateman et al. | Folding target stand |

Non-Patent Literature

| Reference | Date | Source | Title |
|---|---|---|---|
| 1 | Copyright 1999 Firearms Tactical Institute. | WWW.firearmstactical.com/briefs29.htm | An Inexpensive Target Stand You Can Build In a Few Minutes. |
| 2 | May/June 2006 issue | American Handgunner, FMG publications | Cheap and easy target Stands, by Jim Gardner |
| 3 | 2007/2008 | Brownells, Inc. pages 308-309 | Brownells Catalog #60 |
| 4 | 2011 | USA Midway, pages 92-96 | Master Catalog #34 |
| 5 | 2003 | Dixie Gun Works, Inc. page298 | 2003 Catalog #152 |

Recreational, sport practice and competitive shooting have existed at least as long as projectile weapons have been in existence. The goal is always to hit a specific target. The target itself is either self supporting or it is held in place by some other means. The shooter also needs feedback to determine their success in hitting the target, and their accuracy.

Today there are two basic types of targets; either reactive or non-reactive. Reactive targets are intended to be struck by the projectile and remain undamaged, ready for subsequent strikes. The feedback to the shooter is instant indicating that the target was struck being indicated by sound, movement, or other visual means. A non-reactive target means that the target must be inspected to ascertain where it was struck, and how many times. Feedback is not necessarily instantaneous. Non-reactive targets are typically used to give more precise and measured feedback indicating the shooter's skill. Non-reactive targets are the most common type being used, in competitive shooting to provide a score, in recreational shooting for comparative skill feedback, and to sight in weapons.

Both types of targets typically require some means of target support for presentation to the user, and typically it is a target stand. Even a cursory web or literature search will turn up dozens of target stand designs as well as plans for home built stands. Reactive targets typically require a stand that is relatively substantial in that it must support a heavier target and the stand itself must be able to withstand the strike from a projectile without significant damage. Non-reactive targets on the other hand are expected to be destroyed, and the stand is usually separated from the target by support members that are expendable. As such the stands for non-reactive targets are typically lighter, and ideally the farther the target support members separate the target from the stand, the better. Non-reactive target stands that directly support the targets with very little separation are highly likely to be damaged.

One of the most common target stands is referred to as the "H" target stand. An example of this is described under reference number 1 and 2, in non-patent literature. These stands are constructed such that an "H" is fabricated of wood, PVC tubing, or metal. When in use, the "H" lies flat on the ground. The intersection of the horizontal and vertical elements of the "H" is constructed with holes or slots to accommodate the insertion of two or more wood furring strips, PVC pipe, or other expendable material. These inserted elements project out orthogonally from the "H" as it lies flat on the ground, extending upward. It is to these elements that a non-reactive target, such as paper or cardboard is usually attached.

This type of target stand is commonly used in all three shooting disciplines; Recreational, Sport practice and competitive shooting because they are inexpensive and relatively easy to make. There are several "H" type implementations that can even be purchased commercially, with examples being found in references 3, 4, and 5. The "H" type stands suffer a major drawback, and that is, it is reliant on setting it up on a relatively flat, level surface. The "H" shape, which I will generally refer to as a "box base" has at least two long bearing surfaces formed by the construction elements that form the opposing parallel edges of the box base. These long surfaces effectively offer multiple points of contact with the ground, and unless the ground is equally as flat as the surfaces, or soft enough to conform to the surfaces, the stand will be unstable and wobbly.

On commercial ranges that are leveled, indoor shooting ranges, or flat patches of land, the box base type stand works relatively well, however on uneven, rough ground, on slopes, or broken terrain they work very poorly, being inherently unstable and wobbly without either excavating the ground to conform with the stand or the use of some other mechanical means to hold it down.

Without such artifice, a slight breeze can cause the stand to move, which is unacceptable for sighting in a firearm. With a stronger breeze, and with the stands upright support elements being at the outer edge of the base, near the ground contact edge of the stand, and the target acting as a sail, it does not take much force to move the center of gravity beyond the ground contact edge of the stand base, toppling the stand.

The higher the center of gravity is located on the stand, the less force is needed to move the center of gravity beyond the base contact edge. Placing a box base stand on an inclined surface also moves the center of gravity toward an edge because the target extends up orthogonally to the base of the stand. The higher the center of gravity the closer it will be to extending over one of the ground contact edges. As such the amount of incline the stand can be placed on is limited without some other means to hold the stand down. If the inclination is only front to back then the limit is determined by the length that the "H' extends either to the front or rear; side to side support however, is still limited.

When it comes to competitive shooting disciplines, a number utilize anthropomorphic type targets and incorporate shooting scenarios over varied terrain such that the various targets must be placed in unusual shooting presentations with respect to one another and-or obstacles. The box base type target stands, providing only a vertical presentation on flat ground, are wholly unsuited for these types of presentations. When all that is available are box base type target stands then unusual target presentations are usually accomplished by constructing a temporary frameworks of wood strips, cardboard, twine, tape, and other tools at hand on the range. This requires a significant amount of setup time. It is either that approach or target stands are built specifically for a single type of presentation, again requiring significant effort and time. In addition, even if the box base stand is made to be disassembled, it tends to be large and unwieldy for transport and carry, either by size or the number of pieces involved.

There are several examples in previous patent art that suffer from the same shortcomings. For example U.S. Pat. No. 6,491,303 (2002) to Huston, utilizes the same "H" or box base configuration. While more substantial in terms of size and weight, it suffers the same leveling problems. Other U.S. patent art with the box base type of construction are, U.S. Pat. No. 6,435,512 (2002) Beckwith, Sr., U.S. Pat. No. 5,938,203 (1999) Beckwith, Sr., U.S. Pat. No. 5,678,824 (1997) Fortier et al., D329665 (1992) Carroll, U.S. Pat. No. 4,726,593 (1988) Wade, and all exhibit the same shortcomings, unstable over rough or uneven terrain, top heavy with a high center of gravity, unwieldy to carry downrange, or they must be disassembled into a number of pieces.

As a point of understanding, there is a well known engineering/geometric axiom that three points, not in a straight line, define a plane. Regardless of the roughness, or slope of any piece of terrain (excluding vertical), those three points will make contact with the ground. If the center of gravity of the object making those three points of contact is maintained within the triangle formed by those three points on the plane, and the direction of gravity is through that plane then the object will be stable. Anything more than three points of contact is inherently less stable without, perfectly matching the contact points to the ground surface, or by using some other means to compensate such as tie down, stakes, etc. to increase stability.

Any force applied perpendicular to the direction of gravity against the object that moves the center of gravity beyond the edge of the formed triangle will topple the object. The lower the center of gravity to the plane the more force parallel to the plane is needed to move the center of gravity outside said triangle, toppling the stand.

Applied to a target stand that implies two things; optimum configuration for rough ground is three points of contact, with a low center of gravity, wherein that center of gravity is kept vertically within the triangle formed by the three points of contact.

In prior art there have been attempts to mitigate the shortcomings of the box base type stand when it comes to stability or use over uneven terrain. The approaches used can roughly be broken down into three groups:

Weighting or anchoring to stabilize the target stand:

In this group the target stand is stabilized by either physically adding weight to the target stand's base structure, or by using spikes, or stakes physically driven into the ground, or other mechanical means mechanically attached to the stand's base to hold it down.

Examples of this approach are found in U.S. Pat. No. 6,435,512 (2002) Beckwith, Sr., U.S. Pat. No. 7,644,927 (2010) Law, and D600482 (2009) St. John. In each case, where a mechanical hold down is used, the design presents the target with a perpendicular orientation from the base, so while the stand may be steady, there is no compensation or adjustment for that orientation relative to the ground or the user. The only recourse if the ground is not level is to alter the terrain. An exception to this is U.S. Pat. No. 5,598,996 (1997) Rath, which offers one adjustment for terrain. The base is essentially an "H" as in the box base stands, wherein stakes can be driven through the legs and the uprights supporting the target can pivot forward and back about the center bar of the "H" further being held by set screws. This is of limited value if the terrain is sloped sideward, or the target needs be rotated. In addition the use of set screws, which have relatively small bearing surfaces are of limited use in applying enough force to hold the target upright if there is much wind at all. For all of these stands, if the ground is hard, rocky, frozen, or even solid rock, the implementations expecting members to be driven into the ground will not work to provide target stability.

Using legs or points that either rest on or penetrate the ground:

Within this group the base structure is reduced to points; either more than three, or less than three wherein the points can be pressed into the ground to compensate for some terrain unevenness, and if placed deep enough may provide for some stability. The stands with less than three points rely entirely on forcing the points deep enough into the ground for stability. Examples of this approach are U.S. Patent Application Publications 2011/0127723 Haynes, 2010/0225063 Wyrick et. al. U.S. Pat. No. 7,845,646 (2010) Weber, D424652 (2000) Minneman, D388128 (1997) Young, U.S. Pat. No. 5,671,924 (1997) Scott, and U.S. Pat. No. 5,067,683 (1991) Wagner.

This is a fairly sizable group, and offers the advantage over the previous group in that if the points of the stand can be driven into the ground deep enough to support the stand then a greater variety of target presentations are possible so long as the penetration angles do not become too acute. This is particularly for those stands with one or two leg points only; however like the previous group, if the ground is hard, rocky, frozen, or even solid rock, they become essentially useless, not even having the minimum of three legs to stand on.

A variant in this group is U.S. Pat. No. 3,415,519 (1968) Hand. It has four legs, the ends of which it stands on. While not actually presented as points, it offers some adjustability for ground compensation in that two of the legs have hinges that can be used to prop up the stand with some forward or backward target presentation; however again, as in the Rath patent in the previous section its usefulness is limited, not only by the length of the hinged legs (which limit the forward and reverse tilt), but also by the side slope, roughness of the terrain, and an inability to turn the target presentation.

Use of a three point stance, or adjustable stance:

Within this group, are the stands that rely on three legs, or points upon which to stand, and/or the base or legs offer some adjustment to compensate for the terrain. Three legs, or points, is the minimum necessary for providing a self resting stand, and the maximum for a stand that is self stabilizing, without wobble, as long as the center of gravity is kept above and within the defined triangle as previously described. Previous art which describe stands in this category with three legs are U.S. Pat. No. 7,427,069 (2008) Bateman et. Al., U.S. Pat. No. 5,503,356 (1996) Shelby, U.S. Pat. No. 2,899,204 (1959) Ratay, and U.S. Patent Application Publication 2011/0074112 (2011) Allen.

A variant in this group is U.S. Patent Application Publication 2010/0194048 Medina et. al. a stand with an apparent "H" box type base. It is different in that the legs are tubular, and offer some adjustment to the terrain, by allowing the tubes to rotate within what would be the center bar of the "H", the distal ends of the 4 legs can extend out, and the vertical target support can rotate, and be extended. In the patent artwork the stand is shown adjusted resting on stairs; however; it is not shown adapting to arbitrary terrain. Indeed the way that one leg must rotate up, while the other half is rotated down, creates an unbalanced situation. Its quick adaptation for use on arbitrarily uneven terrain is dubious without altering the terrain to compensate for the limitations inherent in the design and still effect the presentation desired.

Another, U.S. Pat. No. 2,069,822 (1937) Douglas, has a hybrid, half box type base with a single leg for the other half. While making it a three point stand, it still lacks any adjustability to compensate for variability in terrain, as well as having a good portion of its mass outside the triangular base, with its center of gravity high, and close to the edge of the base, susceptible to being easily toppled.

U.S. Pat. No. 3,087,701 (1963) Wallace, is an "H" type stand where there are four legs, and each of the legs can rotate about the center bar of the "H", to rest on the ends of the legs. The legs themselves are fixed length. By adjusting the angle of each leg, some degree of compensation for uneven ground can be attained, however it is limited due to the fixed leg length, and beyond that there is no adjustment for side to side, or the targets facing presentation without moving the stand, very similar to the previously mentioned patent, U.S. Pat. No. 3,415,519 (1968) Hand.

U.S. Pat. No. 7,427,069 (2008) Bateman et. Al., and U.S. Pat. No. 5,503,356 (1996) Shelby are both stands that have a three point stance, with foldable and collapsible legs respectively. U.S. Pat. No. 7,427,069 has flat legs that fold up along the target support element and lock in place through the use of pivots and notches. When deployed the legs form a steep acute angle with respect to the ground, narrowing the three point contact base with the ground raising the center of gravity. A single target support element extends vertically up. Being intended for use as reactive target stand the targets are hung directly from the stand itself. There is no means provided to compensate for forward and back tilt, side tilt, or rotation. All must be accomplished by moving the stand, or modifying the terrain.

U.S. Pat. No. 5,503,356 also has legs that fold up along the target support element, and lock in the deployed position by the use of angled retention bars that the legs are rotated into. The target support element extends up vertically, with a second set of target support arms to which a target is attached. Again however there is no means to compensate for forward and back tilt, side tilt, or rotation. All must be accomplished by moving the stand, or modifying the terrain.

In conclusion all the stands heretofore found in the prior art disclosed above have one or more of the following disadvantages:

- Stands with anything greater than a three point contact base, when placed on anything other than flat ground, i.e. uneven terrain, sloped and steeply sloped surfaces, or rocky ground, are inherently unstable, subject to moving, or even being knocked down by impacts, or windy conditions. The higher the center of gravity, the more susceptible they are.
- Stands with anything less than a three point contact base, unless the ground is soft enough or other mechanical hold-down means are employed, are useless on hard, frozen, rocky, or otherwise impenetrable ground.
- Stands with a high center of gravity, that cannot be adjusted such that the vertical force of gravity is maintained within the bounds of the base making ground contact are more susceptible to being unstable, subject to moving, or even being knocked down by impacts, or windy conditions.
- None of the stands are adaptable with multiple degrees of adjustment such that once placed, the orientation, and presentation of the target can be adjusted arbitrarily and at will maintaining the center of gravity within the bounds of the base making ground contact.
- All but three of the stands (U.S. Pat. No. 559,896, D600482, and D329665) are intended for non-reactive targets (i.e. cardboard, paper) and the means provided to attach the target an integral part of the stand making it very likely that the stand itself will be damaged by impacts from errant projectiles. No provisions are made to distance the target from the target stand.
- Stands which are not intended to be collapsible or portable are cumbersome and they are awkward to transport down range. Those that are intended to be portable are either designed to be disassembled, meaning lots of parts to keep together, or they are not designed with a balanced carry point that allows one or more target stands to be carried simultaneously either by hand or carry strap.
- None of the stands are intended to be modular, such that component assemblies can easily be removed, replaced, modified, or substituted by the operator.

SUMMARY

In accordance with one embodiment, an articulated stand with multiple degrees of adjustment comprises a base consisting of a plurality of three legs placed radially symmetrical about a cylinder hub, wherein the legs pivot to one of two positions, position one being the collapsed position, wherein said legs are folded to lie axially along the center axis of the stand and position two being the deployed position such that the legs are splayed out forming a base of three points upon which the stand rests while on the ground. Said legs can be locked in either of the two positions.

Upon the base, pivotally attached to the cylinder hub is a yoke gimbal mechanism offering three degrees of adjustment, respectively about the three orthogonal axes formed by the yoke gimbal mechanism. The center element of the yoke gimbal mechanism is a single vertical upright member, which by the nature of the gimbal can be effectively positioned about the three said axes to any position. That position is selectively held in place by integrated locking mechanisms.

Upon the distal end of the upright member that is the center element of the yoke gimbal mechanism, a horizontal target support assembly is centered and pivotally attached such that the target support assembly can rotate about the axis of the upright member providing one more degree of adjustment.

The rotational position of the target support assembly is also selectively held in place by an integrated locking mechanism.

The target support assembly further integrates vertical receivers into which common, commercially available and expendable, target supports can be inserted and mechanically held in place. It is to these expendable supports that a target is attached keeping a distance between the target stand and the target.

Summary Advantages

Accordingly several advantages of one or more aspects of the stand over previous embodiments are as follows:

That the stand provides multiple degrees of adjustment to compensate for uneven, rough, and inclined ground surfaces as well as for setting up unique target presentations in competitive shooting scenarios, without the need to alter the terrain or surface upon which it sits.

That the stand provides for a wide three point stance, with a large diameter footprint for stability, with a low center of gravity, and the ability to adjust the target, effectively changing the center of gravity to keep the center of gravity near the center of base making it difficult for the stand to become off balance regardless of the terrain it is placed on.

That the stand provides for the use of standard wood furring strips or other materials as target support members, of the type commonly used in competitive shooting disciplines (or other user acquired support material), distancing the target from the stand itself, and providing a means for fastening those support members to the stand when unusual target presentations are utilized.

That the stand provides a means for adjusting to standard target widths most commonly used in competitive and recreational shooting.

That in the stand's collapsed state the stand is further implemented such that the target support assembly, when rotated to align with the folded legs an integral carry handle is formed at the balancing point of the stand as it is held horizontally; further attaching a carry strap to connection point integrated into the target support assembly make the entire stand easily carried hands free.

That in the deployed state, the target support assembly being at or near the center of gravity again forms a natural carry handle about the cylinder axis of the stand such that the stand can be lifted with a single hand from the center, and easily carried to a new position as the deployed legs do not interfere with natural walking while holding the stand to the side.

Other advantages of one or more aspects will be apparent from a consideration of the drawings and ensuing description.

DRAWINGS

Figures

DRAWINGS

Reference Numerals

Figure 1:
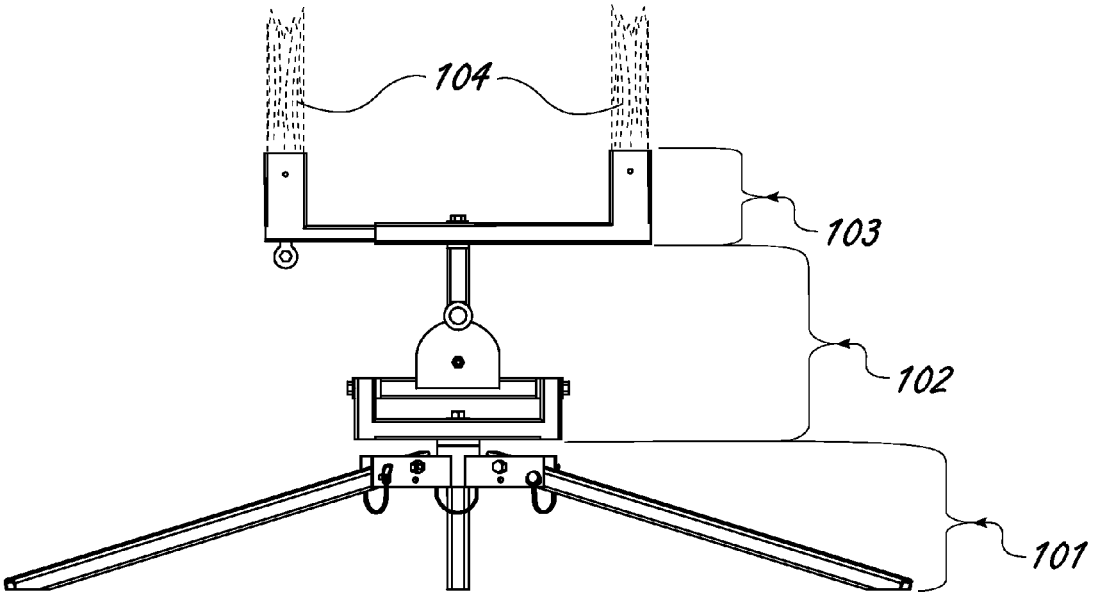
FIG. 1 is a frontal view of the articulated target stand with each of its main assembly groups indicated in accordance with one embodiment.

101 base leg assembly
102 yoke gimbal assembly
103 target support assembly
104 common wood furring strips
211 base cylinder hub
212 base cylinder cap
213 base cylinder cap threaded hole
221 base cylinder axis
222 base/yoke gimbal plane of rotation
231 yoke gimbal lower pivot bolt
232 yoke gimbal lower pivot bolt washer
241 yoke gimbal upright post axis
242 yoke gimbal/target beam support plane of rotation
251 target support pivot bolt
252 target support pivot bolt washer
261 yoke gimbal upright post
262 yoke gimbal upright post end plug
263 yoke gimbal upright post end plug threaded hole
271 yoke gimbal lower yoke
281 target support beam outer tube
291 target support beam inner tube
314 base leg flange plate
315 base leg pivot hole
316 base collapsed leg locking pin hole
317 base extended leg locking pin hole
321 stand Leg
322 stand Leg collapsed locking pin hole
323 stand Leg pivot hole
324 stand leg extended locking pin hole
325 stand leg anchor hole
331 leg locking pin
341 leg pivot bolt
342 leg pivot bolt locking nut
410 stand leg angle of separation and axial symmetry
510 stand leg movement from the deployed to the collapsed position
611 yoke gimbal upright post angle carriage lock bolt
612 yoke gimbal upright post angle carriage lock bolt front washer
613 yoke gimbal upright post angle carriage lock bolt nut

614 yoke gimbal upright post angle carriage lock bolt rear washer
621 yoke gimbal horizontal pivot tube
622 yoke gimbal upright post lock plate
623 yoke gimbal horizontal pivot tube end plug
624 yoke gimbal horizontal pivot tube end plug threaded hole
625 yoke gimbal upright post lock plate pivot hole
631 yoke gimbal horizontal pivot tube bolt
632 yoke gimbal horizontal pivot tube bolt washer
641 yoke gimbal horizontal pivot tube axis
642 yoke gimbal horizontal pivot tube plane of rotation
651 yoke gimbal upright post angle pivot axis
652 yoke gimbal upright post angle pivot plane of rotation
664 yoke gimbal upright post friction lock back plate
665 yoke gimbal upright post carriage bolt hole
667 yoke gimbal upright post pivot hole
672 yoke gimbal lower yoke pivot hole
673 yoke gimbal lower yoke horizontal tube pivot hole
681 yoke gimbal upright post angle pivot bolt
682 yoke gimbal upright post angle pivot bolt lock nut
720 yoke gimbal horizontal pivot tube extents of rotation
710 yoke gimbal upright post angle pivot extent of rotation
811 target support beam receiver threaded thumbscrew holes
821 target support beam receiver thumbscrew
831 target support beam width adjustment holes
841 target support beam carry position hole
851 target stand adjustment flat wrench
882 target support beam outer tube upright receiver
892 target support beam inner tube upright receiver
911 target support beam inner tube width size markings
912 target support beam outer tube width size markings
913 target support beam tube width alignment indicia
921 target support beam inner tube position mark
922 target support beam outer tube position marked hole
1011 target support beam carry strap holes
1021 carry strap
1031 hand at carry point
1111 target stand deployed on a hillside
1112 target stand deployed in scenario partially obscuring second target
1113 target stand deployed in scenario angled out behind another
1114 target stand deployed at extreme angle behind obstacle
1201 alternate target support assembly embodiment of fixed length
1202 alternate target support assembly using a vertical receivers
1203 horizontal receivers

DETAILED DESCRIPTION

An embodiment of the present invention is described herein with references to the accompanying drawings.

FIG. 1 is a front view of the articulated target stand showing the three major assemblies. The base assembly 101 pivotally connects to a three axis yoke gimbal assembly 102, which then pivotally attaches to a target support assembly 103. Because of the modular implementation of this embodiment of the target stand, different embodiments of target support assembly are possible, and can be attached as needed. In the embodiment shown in FIG. 1, a 'U' shaped, telescoping embodiment of the target support assembly is shown in which commonly available wood furring strips 104 or other expendable support elements are attached. Said expendable support elements, not part of this invention, are used to attach to and support the actual target, distancing it from the target stand itself in order to minimize possible damage by impact from errant projectiles.

Figure 2:
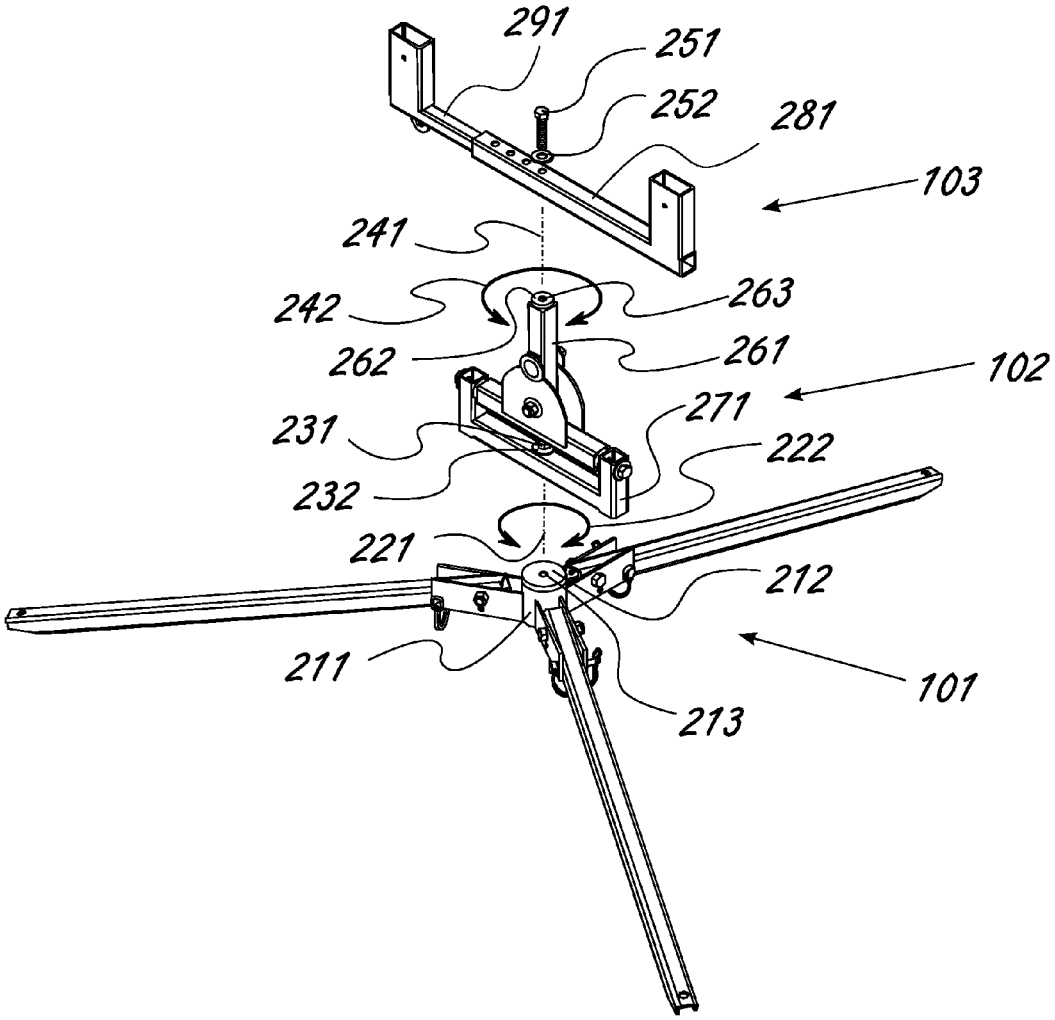
FIG. 2 is a partially exploded isometric view of the articulated target stand separating its three main assembly groups.

FIG. 2 shows the target stand from an upper front isometric view partially exploded, separating the three assemblies from FIG. 1. The center of the base assembly 101 is a short cylinder hub 211 oriented such that the cylinder axis 221 is vertical. The upper end of said cylinder hub is integrally formed with a flat cylinder cap 212, such that the center of said cylinder cap has an integrally formed threaded hole 211 oriented along the same vertical axis 221. This arrangement provides for a plane of rotation 222, parallel to the surface of the cylinder cap 212, about the vertical axis 221, to which the next assembly, the yoke gimbal assembly 102 is pivotally connected.

Figure 6:
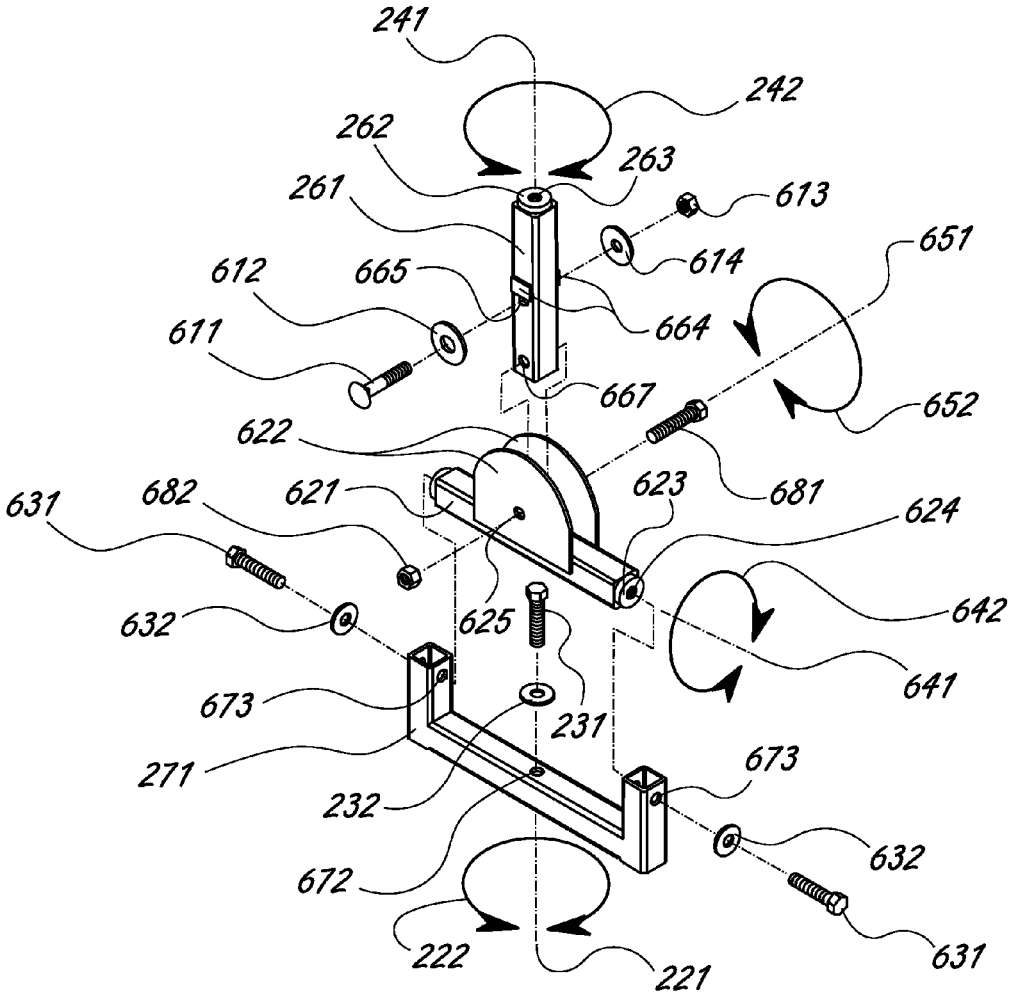
FIG. 6 is an exploded isometric view of the yoke gimbal assembly.

The yoke gimbal assembly 102 is attached to the base assembly 101 via the yoke gimbal lower bolt 231 and washer 232, shown with further detail in FIG. 6. Yoke gimbal bolt 231 extends through the washer 232 then through the bottom center pivot hole 672 of the yoke gimbal lower yoke 271 to the mating base cylinder cap threaded hole 213. This connection provides a pivot point between the base assembly 101 and the yoke pivot assembly 102 such that said assemblies can be adjusted relative to one another on the horizontal plane 222 about the axis 221.

The yoke gimbal lower bolt 231, in combination with the yoke gimbal lower bolt washer 232 allows the position of the yoke gimbal assembly 102, about the axis 221, to be locked into any position on the horizontal plane 222, by tightening the yoke gimbal lower bolt 231, compressing the washer 232, against the yoke gimbal lower yoke 271, and hence compressing said lower yoke against the base cylinder cap 212, holding the relative position of the two assemblies by friction, without damaging the upper surface of the yoke gimbal lower yoke 271.

In a similar fashion, the upper end of the yoke gimbal assembly 102 consists of a yoke gimbal upright post 261 whose axis; the yoke gimbal post axis 241 is oriented vertically. The top distal end of the yoke gimbal upright post 261 has an integrally formed flat end plug 262 further integrating a threaded hole 263 coincident with the axis of the same upright post 241.

A target support assembly 103 attaches to the yoke gimbal assembly 102 by the use of the target support pivot bolt 251 which extends through the target support bolt washer 252, the target support assembly 103, and into the mating yoke gimbal upright post end plug threaded hole 263. This connection provides a second pivot point about the yoke gimbal upright post axis 241, on the yoke gimbal/target support plane of rotation 242, between the yoke gimbal assembly 102 and the target support assembly 103. This connection makes the rotational relationship between the base assembly 101, and the yoke gimbal assembly 102, independent of the rotational relationship between the yoke gimbal assembly 102 and the target support assembly 103.

The target support pivot bolt 251, in combination with the target support pivot bolt washer 252 allows the position of the target support assembly 103, about the yoke gimbal upright post axis 241, to be locked into any position about the horizontal plane 242, by tightening the target support pivot bolt 251. In this embodiment the target support assembly consists of a target support beam inner tube 291, and a target support beam outer tube 281, which telescope together allowing corresponding holes to align through which the target support pivot bolt 251 can be passed. Tightening the target support pivot bolt 251, compresses the target support pivot bolt washer 252, against the target support beam outer tube 281, and hence compressing said target support beam against the yoke gimbal post end plug 262, holding the relative position of the two assemblies by friction, without damaging the upper surface of the target support beam outer tube 281 by pressure from the target support pivot bolt 251.

Figure 3:
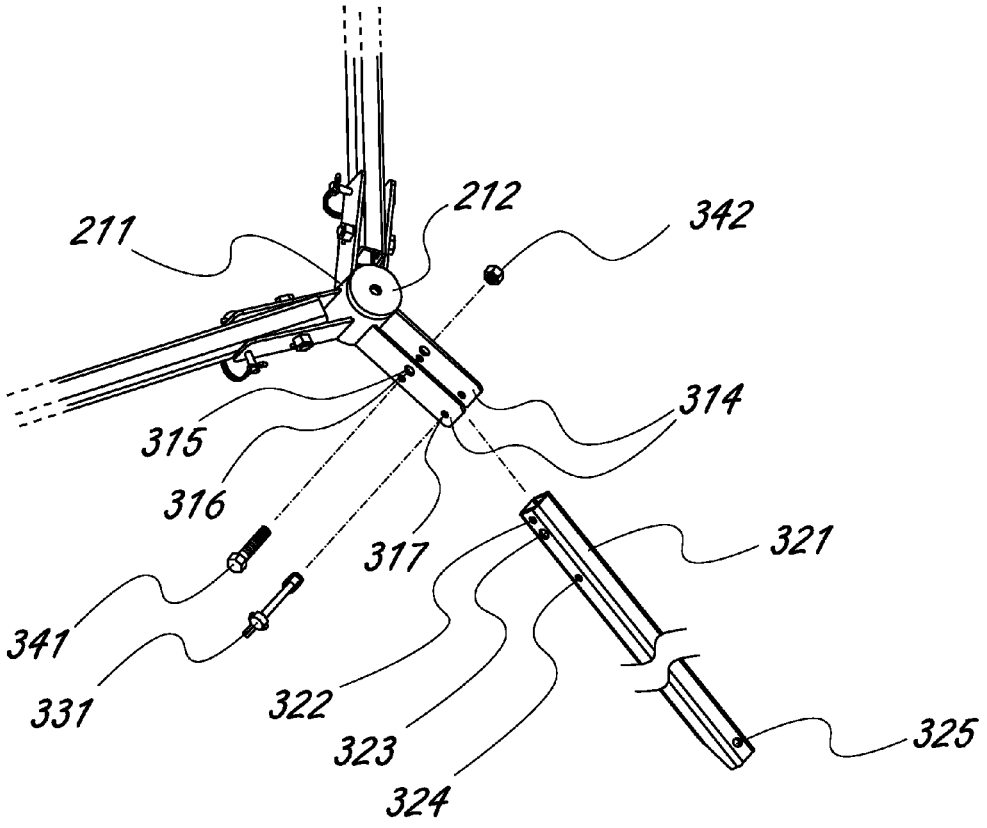
FIG. 3 is an angled, top down, partial exploded view of just the base leg assembly.

FIG. 3 is an oblique partially exploded view of the base assembly 101. The base assembly is comprised of the base cylinder hub 211 which is a short cylinder as described in FIG. 2 oriented vertically. Integrally attached to the outer vertical surface of the base cylinder hub 211 is three pair of base leg flange plates 314. The longest extent of said plate pairs 314 extend axially away from the hub center with their shortest extent oriented vertically, parallel to the base cylinder axis 221 and the vertical placement of each plate about the base cylinder hub 211 is identical. Each flange plate pair 314 is further oriented such that the pairs are evenly spaced axially about the surface of the base cylinder hub 211, and the plate surfaces of each said pair are parallel with one another being separated to an extent such that a base leg 321 can slip easily between a flange plate pair 314. Further, each base leg flange plate pair 314 has three holes, 315, 316, and 317 extending through each plate. Each plate in a pair must be oriented such that the location of the holes in each plate is coincident with the corresponding hole in the other plate making up the pair such that a pin inserted in one hole will align and pass through the corresponding hole in the second plate of the pair.

The base assemble 101 is further comprised of three stand legs 321. In this embodiment, each stand leg consists of a single linear square tube or the like of sufficient length to provide an adequate three point support base for the stand. It is to be noted that the cross section or material and length of the stand leg is not limited to the configuration as stated. The longer the length of a leg the more stable the stand will be, and the shorter the less stable. In contrast the longer the legs the more unwieldy the stand is when folded into the carry configuration FIG. 10. One end of each leg 321 is configured such that three holes 322, 323, and 324 are formed through the leg such that the tree holes are aligned along what would be the edge of a plane passing through the center axis of the leg, passing through the leg to the opposite side. Said holes are further formed such that when the stand leg 321 is placed between a pair of base leg flange plates 314, the stand leg pivot hole 323 will align with the base leg pivot holes 315, allowing a leg pivot bolt 341 to be inserted through the pivot hole 315 of one plate 314, passing though the leg pivot holes 323, and on through the pivot hole 315 of the second flange plate in the pair. The leg pivot bolt lock nut 342 is then placed on the leg pivot bolt 341, and tightened only to the point that the leg is free to pivot between the flange plates without binding. This is repeated with the remaining plate pairs about the base hub.

The leg extended locking pin hole 324 in the stand leg is formed such that when the leg is attached to the base leg flange plates 314 via the pivot bolt 341, said hole 324 will align with its corresponding base extended leg locking pin hole 317 in the flange plates. The alignment of said holes is formed such that the stand leg is positioned in the extended position wherein the angle of the leg formed with respect to the ground is depressed from the horizontal effectively lifting the stand from the ground relying entirely on the distal ends of the legs to contact the ground. All three legs extended as such form a three point stance on the ground. By pivoting the legs such that the extended locking pin holes 317 and 324 align, the leg locking pin 331 is inserted through both plates and leg, locking the leg in the extended position.

In a similar fashion, the leg collapsed locking pin hole 322 is also formed such that when the leg is attached to the base leg flange plates 314 via the pivot bolt 341, said hole 322 will align with its corresponding base collapsed leg locking pin hole 316 in the flange plates. The alignment of said holes is formed such that the stand leg is positioned in the collapsed position. The collapsed position is with the leg rotated such that the leg is parallel with the axis of the base cylinder hub 221. Pivoting the legs to the collapsed position, the collapsed locking pin holes 316 and 322 align; and the leg locking pin 331 is inserted through both plates and leg, locking the leg in the collapsed position.

Near the distal end of each leg 321, an integrally formed hole, the leg anchor hole 325 is located extending vertically through the leg. This hole is provided such that a metal stake or spike can be driven through the hole staking the stand to the ground for fixing the position to a single spot, for additional stability, or it can be used to suspend one leg from a vertical surface allowing the entire stand to be used against a wall or other structure projecting the target orthogonally out from the structure.

Figure 4:
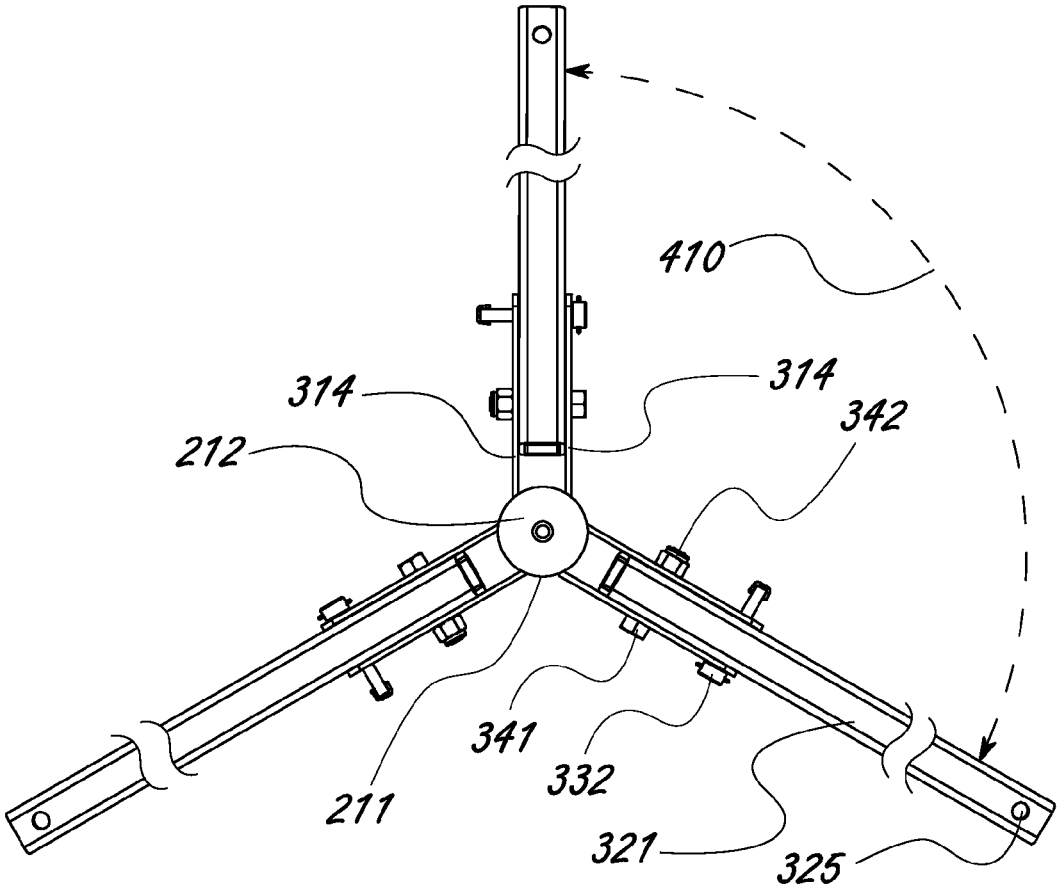
FIG. 4 is a top down view of the base leg assembly.

FIG. 4 is a top down view of base assembly 101, showing many of the elements described in FIG. 3, as they are assembled, with the legs 321 in the deployed position, all three being identical and symmetrical about the axis of the base cylinder hub 211, with an angle of 120 degrees between them 410 in this embodiment. It is noted that while 120 degrees is optimal for stability, a three point stance does not require this and some embodiments may vary from a symmetrical arrangement to an asymmetrical arrangement about the cylinder hub potentially sacrificing stability.

Figure 5A:
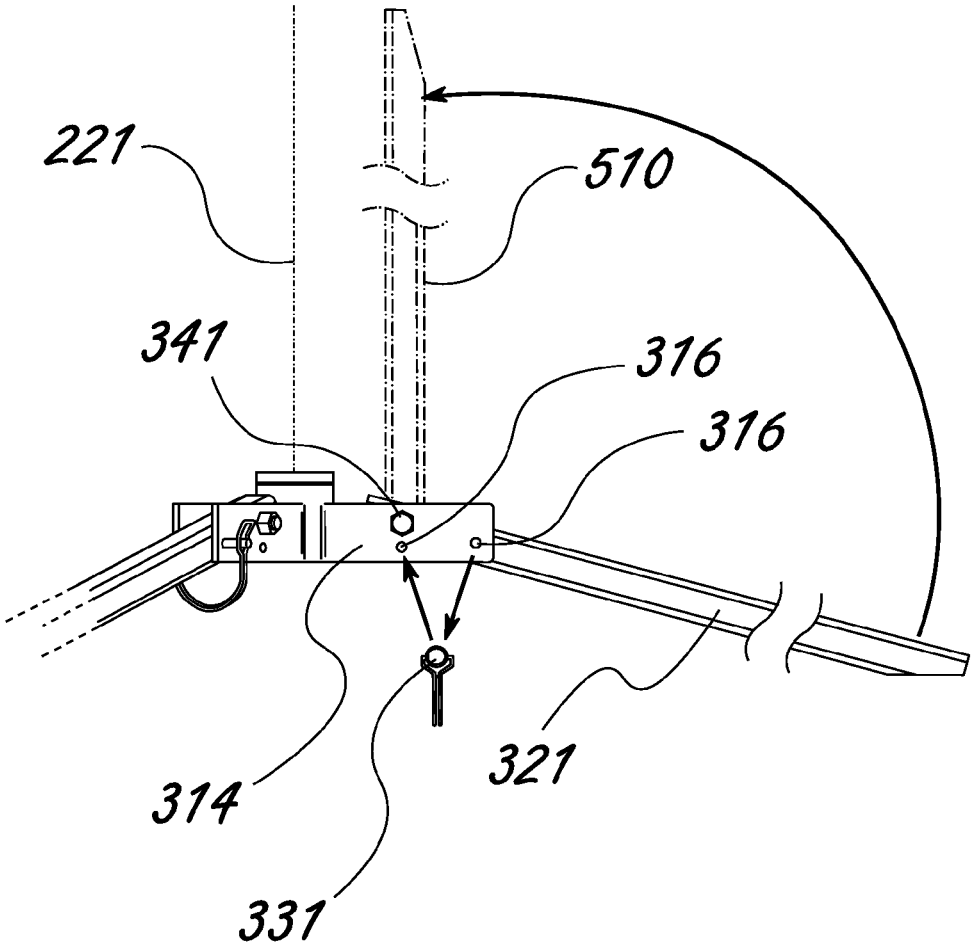
FIG. 5A is a partial side view of the base leg assembly showing a leg in its deployed position.
Figure 10:
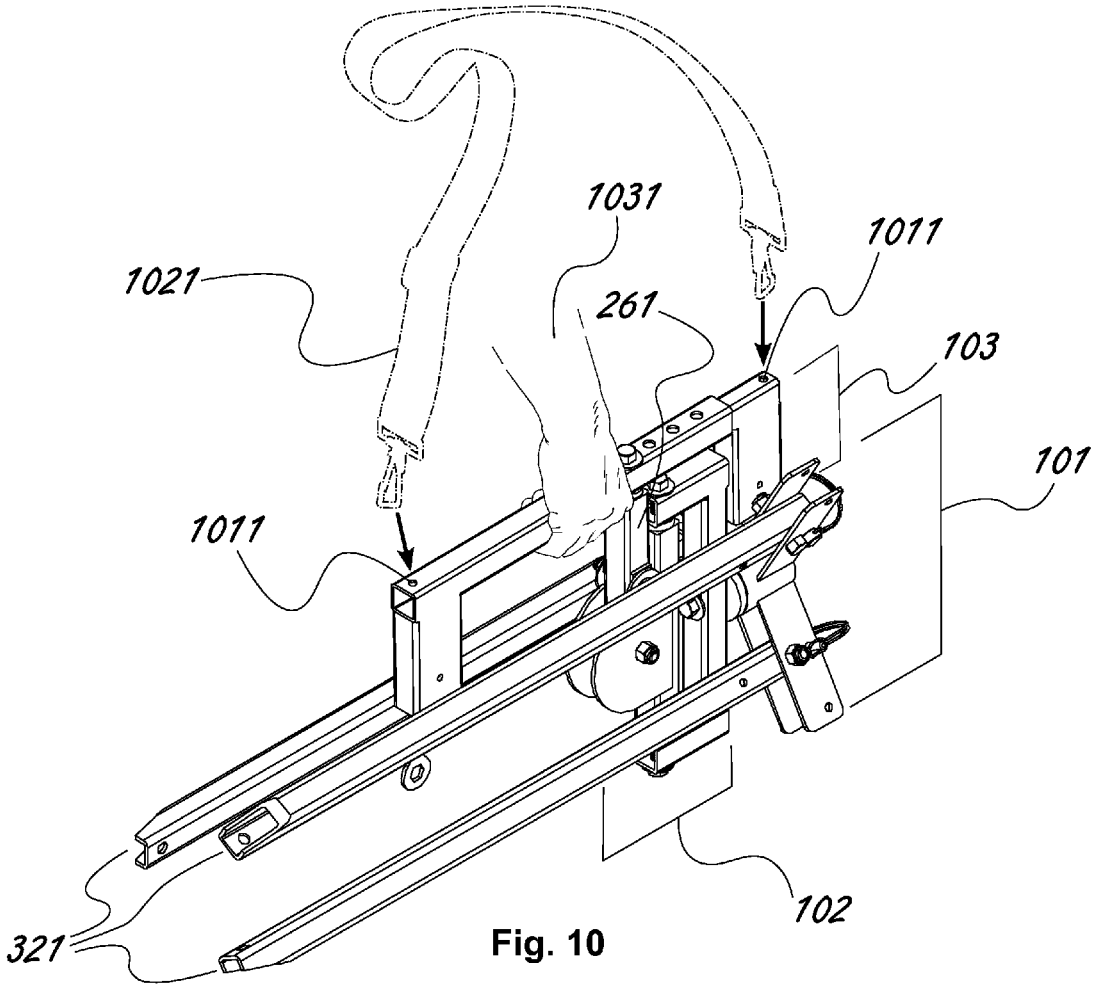
FIG. 10 is an isometric view of the articulated target stand collapsed for carry.

FIG. 5*a* is a partial side view of base assembly 101 showing a single leg 321 in the extended position, as well is its relative position in the collapsed position shown by phantom lines 510. To move the leg from the extended position to the collapsed position the locking pin 331 is removed from the locking pin hole 317 freeing the leg to rotate about the leg pivot bolt 341. Rotating the leg to a vertical position parallel to the base cylinder axis 221 will align the leg collapsed locking pin hole 322 with the flange collapsed locking pin hole 316, and the locking pin 331 can be inserted, locking the leg into the collapsed position. FIG. 10 shows all legs locked into the collapsed position for carry.

Figure 5B:
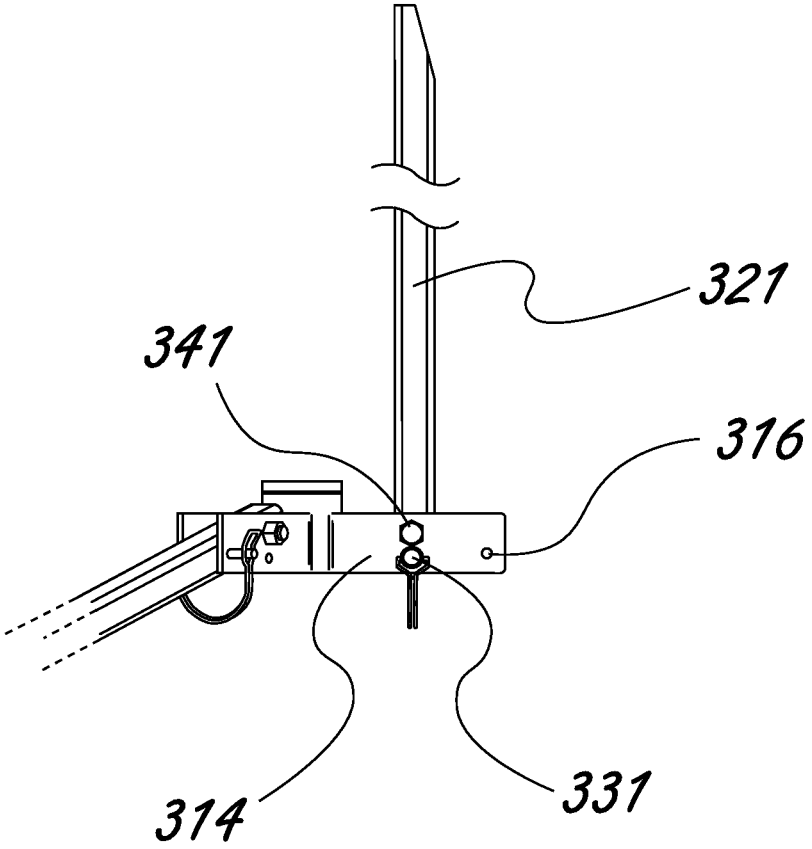
FIG. 5B is a partial side view of the base leg assembly showing the same leg of FIG. 5A moved to its collapsed position.

FIG. 5*b* is the same partial side view as in FIG. 5*a*, however the stand leg 321 is now in the collapsed position and the locking pin is in place.

FIG. 6 is an exploded, isometric view of the yoke gimbal assembly 102. Besides the two planes of adjustment 222 and 242 shown here and described in FIG. 2, there are two additional planes of adjustment 642 and 652 available with the yoke gimbal assembly.

The lower portion of the yoke gimbal assembly is the flat 'U' shaped lower yoke 271. It is though the center of this yoke, and the washer 232 that bolt 231 is inserted to mate with the base cylinder cap threaded hole 213. Tightening the bolt 231 allows the yoke 271 and hence the yoke gimbal assembly to be locked in any position about the plane 222 with respect to the base assembly 101. The distal ends of the upright portions of the 'U' that is the lower yoke 271, have integral holes, the lower yoke horizontal pivot holes 673, that extends entirely through the upright portions of the lower yoke, and whose hole axis are coincident with each other, and whose axis also aligns with and is parallel to the beam that makes up the lower portion of the 'U' shaped yoke.

Between the 'U' shaped ends of the Yoke is placed a horizontal pivot tube 621. Each end of the pivot tube has an integrally formed flat end plug 623 such that the center of said end plug has an integrally formed threaded hole 624. The combined length of the pivot tube and integral end plugs is such that it slips snuggly between the upright ends of the 'U' that is the lower yoke 271. Once between the yoke uprights, the axis of the threaded holes 624 of the pivot tube align with the yoke horizontal pivot holes 673. Inserting the yoke gimbal horizontal pivot bolt 631, through a washer 632, and then the horizontal pivot hole 673, one in each end of the lower yoke uprights, allows the horizontal pivot tube to rotate about the horizontal axis 641. The rotational position of the horizontal pivot tube about the axis 641 can then be locked into any position on the vertical plane 642 by tightening the bolts 631 on each side of the lower yoke uprights 271.

Integral to the horizontal pivot tube 621, along the pivot tube horizontal length are two parallel lock plates 622, that extend from approximately the middle of the horizontal pivot tube along its length for approximately one half the total length of the tube, and then above the tube for approximately the same distance. The two parallel plates are separated by the width of the horizontal pivot tube 621. At approximately the center of the two parallel lock plates 622, is the upright post lock plate pivot hole 625, piercing the plates and whose axes are coincident with one another to form a pivot point for the yoke gimbal upright post 261 about its pivot hole 667 which is later placed between the lock plates. From the center of the lock plate pivot holes 625, along a base line that is parallel to the axis of the pivot tube 641, the upper half of the lock plate forms a semicircle. Thus the upper portion of those two parallel lock plates 622 are semicircles whose centers are formed by the pivot holes 625 while the lower portion of those two lock plates are rectangular, whose bottom edges are integrally attached to and centered along the horizon pivot tube. The axis that extends between these two holes 625 in the parallel lock plates 622 forms the fourth axis of rotation 651.

The yoke gimbal upright post 261 has, at its lower end, the upright pivot hole 667 which extends entirely through the yoke gimbal upright post, perpendicular to what would be the axis of said upright post. The yoke gimbal upright post 261 then slips between the two parallel lock plates 622 such that the angle pivot holes 625 align with the upright pivot hole 667. The upright pivot bolt 681 is then placed through the aligned holes whereupon lock nut 682 is attached to the pivot bolt and tightened. The lock nut 682 is tightened until the parallel lock plates 622 compress but still provide a loose enough fit such that the yoke gimbal upright post 261 can pivot freely on the angle pivot axis 651 formed by upright pivot bolt 681 and the lock plate pivot holes 625.

In order to be able to lock the yoke gimbal upright post 261 at a given angle along the plane 652 formed about the axis 651 and parallel to the lock plates 622; another hole, the carriage bolt hole 665 is placed through the upright post 261, such that it is perpendicular to the face of the lock plates and just above the top edge of the semicircular edge forming the lock plates 622. As such, when the yoke gimbal upright post is rotated about the pivot bolt 681, the bolt hole 665 remains at a fixed distance just beyond the semicircular edge of the lock plates 622.

Just above the carriage bolt hole 665 of the yoke gimbal upright post an integral friction lock back plate 664 protruding from opposing sides of the yoke gimbal upright post 261. The thickness of each protrusion is the same thickness as the parallel lock plate 622 making the surfaces of the parallel lock plates 622 and the lock back plates 664 coincident separated by the space of the locking bolt hole 665.

A standard carriage bolt 611, sized to the bolt hole 665 is inserted into a washer 612. The washer is sized such that the center hole of the washer allows the square neck of the carriage bolt to pass through it with the surface of the washer coming to rest against the underside of the carriage bolt head. The carriage bolt 611 with the washer 612 is then inserted into the carriage bolt hole 665 of the yoke gimbal upright post 261 passing out the other side. The carriage bolt 611 is rotated such that the remaining extent of the carriage bolt's square neck is between, and engages the edge surfaces of the of the parallel lock plate 622 and the lock back plate 664 with the underside of the washer 612 straddling the bolt hole 665, resting against the surfaces of both plates.

Onto the extent of the carriage bolt protruding through the back side of the yoke gimbal upright post, a second washer 614 is placed, followed by the nut 613. This arrangement forms a means by which compression is used to lock the yoke gimbal upright post 261 in position about the upright post pivot axis 651. When the nut 613 is tightened, pressure is transmitted simultaneously against the washers 612 and 614, and hence against the parallel plates 622. Only the nut 613 needs to be tightened, as the square neck of the carriage bolt is kept from turning by its engagement with the edges of the parallel lock plate 622 and the lock back plate 664.

In summary, the positioning and locking of the angular components of the target stand in this embodiment are made by respectively loosening and tightening the bolts 631 for placement about the horizontal axis 641, bolt 231 for placement about the vertical axis 221, nut 613 for placement about the horizontal axis 651, and bolt 251 for placement about the vertical axis 241.

Figure 7A:
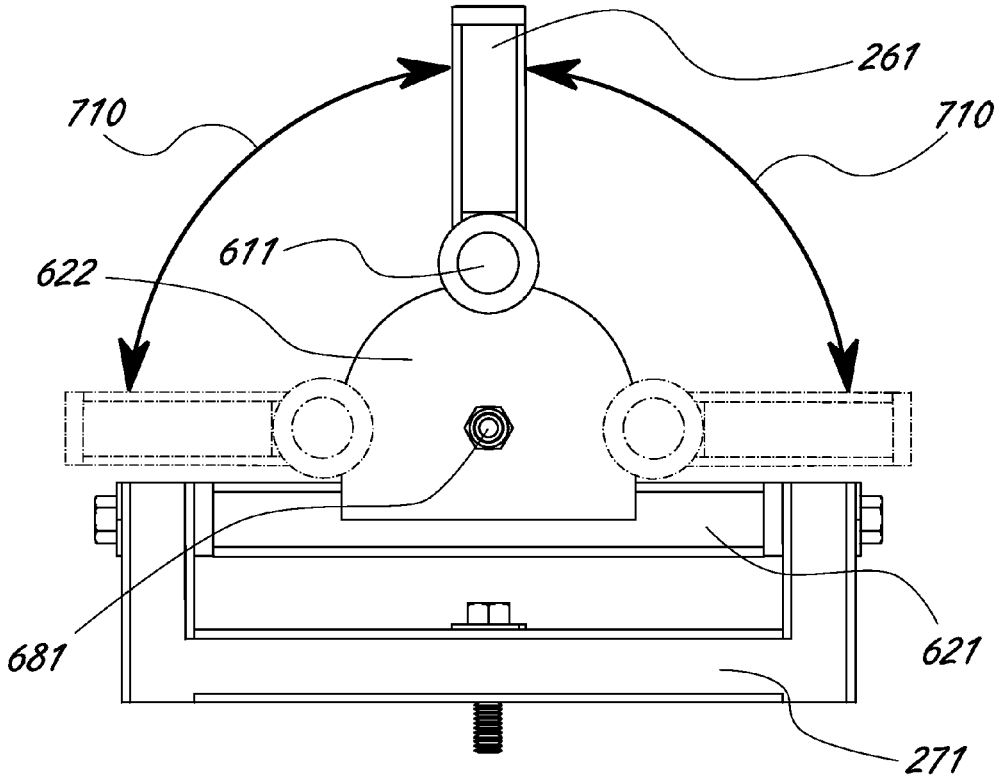
FIG. 7A is a frontal view of the yoke gimbal assembly showing the range of the lateral rotation.

FIG. 7A is a frontal view of the yoke gimbal assembly 102, showing the extents 710, in the plane of rotation 651, to which the yoke gimbal upright post 261 can be rotated about the pivot bolt 681.

Figure 7B:
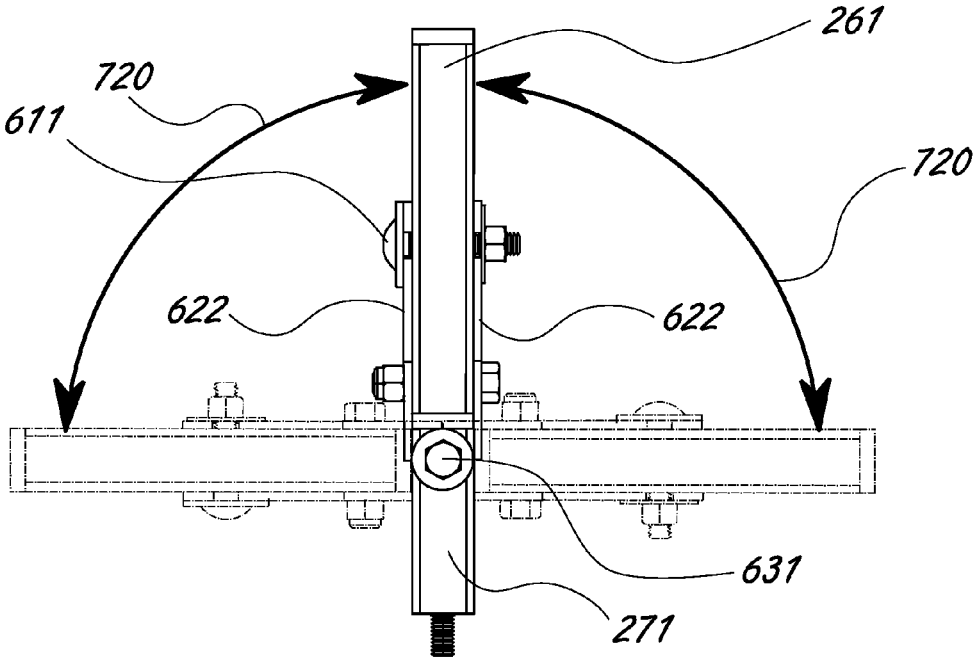
FIG. 7B is a side view of the yoke gimbal assembly showing the range of the front to back rotation.

FIG. 7B is a side view of the yoke gimbal assembly 102, showing the extents 720, in the plane of rotation 641, to which the upright post 261 can be rotated about the pivot bolts 631 on each side of the lower yoke 271.

Figure 8:
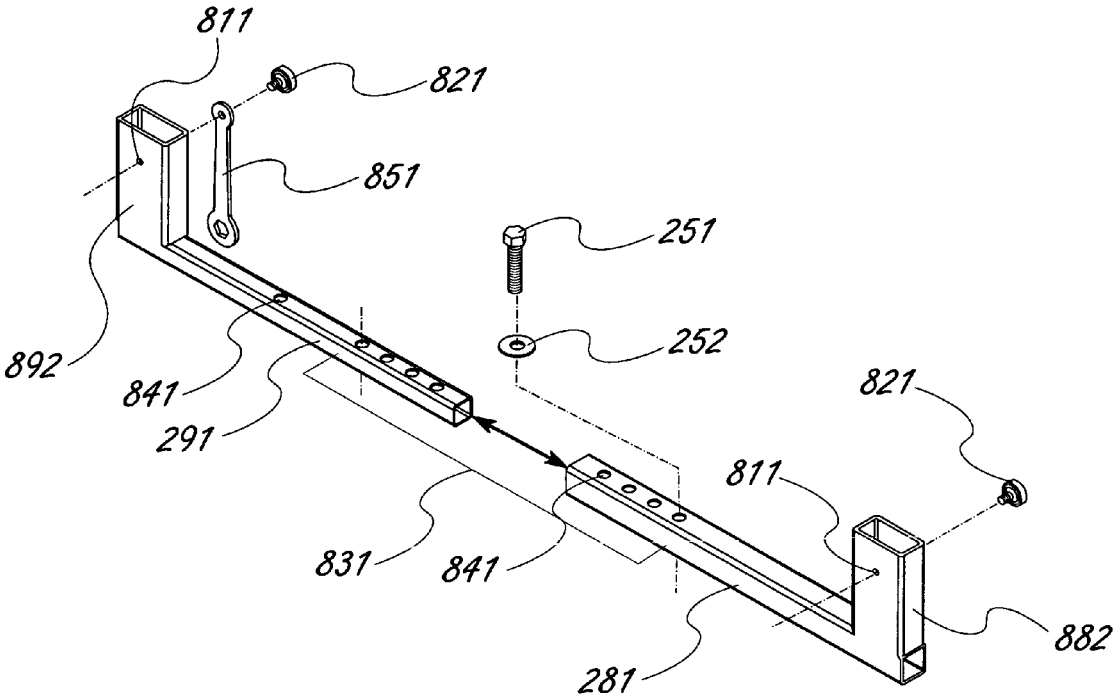
FIG. 8 is an exploded isometric view of the target support assembly.

FIG. 8 is an exploded, isometric view of the target support assembly 103. There are two 'L' shaped beams constructed of square tubing, are such that the member making up the base of the 'L' beam is longer than the upright portion. Said beams are implemented such that the inner support beam 291 telescopes into the outer support beam 281 allowing the width of the target support assembly as a whole to be adjusted. The uprights of the 'L' on the distal ends of the beams, form a cupped, rectangular shaped receiver 882 and 892, such that they can accommodate the insertion of commonly available wood furring strips 104 or other expendable support members to which standard, commercially available cardboard targets can be attached.

To hold the support members in place regardless of the orientation, and position of the stand, threaded holes 811 are placed at the upper end of the beam upright receivers 882 and 892, through each side, such that thumbscrews 821 can be screwed through the tube into the support member 104 used. In this embodiment, in order to simplify the adjustment of the target presentation, all bolts and nuts are the same size so that a single wrench can be used. A flat wrench 851 is implemented, for just that purpose, eliminating the need for additional tools, and the upper end of the wrench is provided with an integral hole, allowing it to be attached to the stand the either by use of the thumb screws 821, or one of the locking pins 331 when it is not in use.

In this embodiment the width of the target support assembly 103 can be adjusted. This is because the width of commonly available targets varies. The width of the target support beam is adjustable via a set of matched holes 831 placed in both target support beams 281 and 291. The adjustment holes are oriented such that the axes of the holes are vertical, being parallel with the uprights 882 and 892 extending completely through the beams.

The target support beam is attached to the yoke gimbal assembly 102 via the threaded cap of the yoke gimbal upright post 263. First the inner support beam 291 is inserted into the outer support beam 281, with both receivers 882 and 892 oriented the same direction. The telescoping beams are adjusted such that a hole in the inner beam aligns with a hole in the outer beam allowing the beam pivot bolt 251 to be inserted thought the washer 252, through the hole in the adjoined beams, and on into the yoke gimbal upright post threaded cap 263. This locks the two beams together with a given separation between ends, and tightening the bolt 251 locks the beam in place about the upright post axis 241.

Hole 841 is placed specifically through the inner support beam such that when the beams are telescoped together to their shortest extent the hole 841 aligns with an existing hole in the outer support beam and that hole is used to mount the target support beam to the stand in the collapsed carry position as further described in FIG. 10.

Figure 9A:
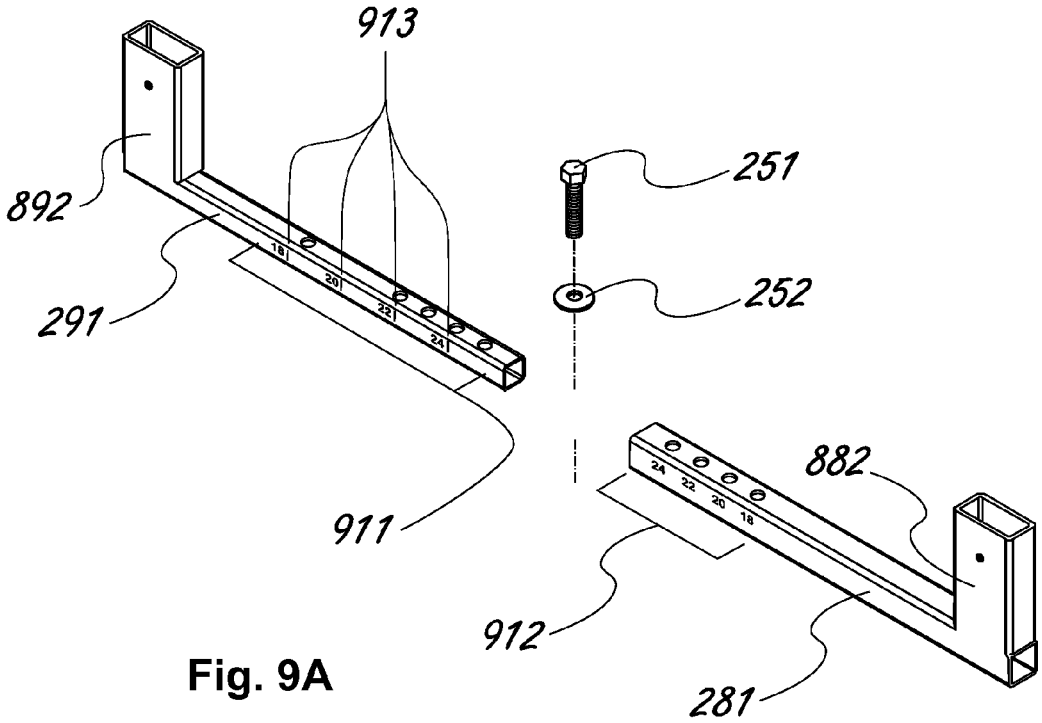
FIG. 9A is an isometric view of an embodiment of the target support assembly which utilizes indices as an aid for adjusting the width and centering the assembly on the yoke gimbal assembly.

FIG. 9A is an isometric exploded view of target support assembly 103 and the details by which width adjustments are made. Matching adjustment indices are integrated onto the surface of both the inner and outer support beams, not only providing a means for adjusting widths to standard target sizes, but also for keeping the target support beam centered on the yoke gimbal upright post 261 for each adjustment. The outer target support beam 281 has a set of numbers 912 indicating the standard width adjustments possible for the embodiment. In this embodiment the numbers represent inches, being 18, 20, 22 and 24; however it is not limited to these increments or widths. These numbers are also located on the inner support beam 291. On the outer support beam, the numbers are located on the surface of the tube, each near a specific hole. For a specific width, the number corresponds not only to the width, but also to the correct hole to use on the outer beam for inserting bolt 251.

The inner support beam 291 has the same corresponding numbers 911; however they are spaced at twice the distance as the numbers and holes 912 on the outer support beam 281. As the numbers on the inner support beam 911 do not directly correspond with an adjacent hole, alignment indicia 913 is located near the numerical marks 911. The alignment indicia are positioned on the inner beam such that when the inner edge of the outer beam aligns with one of the indicia, the hole on the outer beam which is marked with the same number as that which corresponds with the number next to the indicia will be aligned with the correct hole on the inner beam. Inserting the bolt through these aligned holes at the corresponding numbered hole, insures that the assembled target support beam will be centered on the yoke gimbal upright post.

Figure 9B:
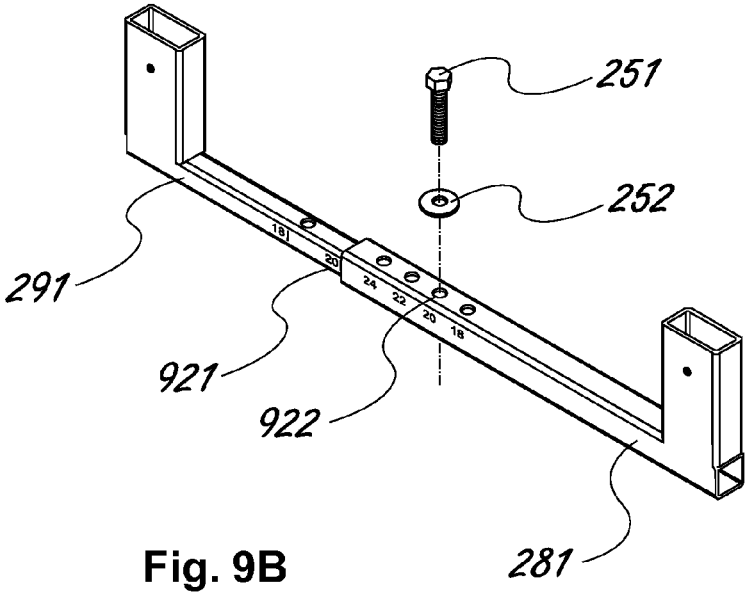
FIG. 9B is the isometric view of FIG. 9A adjusted for a specific width in accordance with the indices provided.

FIG. 9B is an isometric view of target support assembly 103 shown adjusted for the predetermined width indicated by '20'. The outer support beam 281 is slid over the support beam 291 until the inner end of beam 281 aligns with the corresponding alignment indicia for '20' 921 on the inner support beam 291. Once aligned, bolt 251 is inserted through corresponding washer 252, and on into the hole marked '20' 922 on the outer support beam 281. The protruding end of bolt 251 is then threaded into the mating threaded end plug 262 on the yoke gimbal upright post 261. While the adjustment markings provide a means for easily setting the width of the target support beam for standard sizes, and keeping them centered on the yoke gimbal upright post 261, the holes can be used for making odd sized adjustments as well as offsets for unusual target placements, when centering the target is not required.

FIG. 10 is an isometric view of the entire stand collapsed to the carry configuration. The stand legs 321 are all collapsed as described in the text for FIGS. 5*a* and 5*b*. The entire target support assembly 103, is collapsed using the hole location 841 as described for FIG. 8., removed, inverted and then reattached to the yoke gimbal upright post 261, with the yoke gimbal upright post 261 having been rotated to either of its extreme positions as described for FIG. 7A, and the target support assembly 103 being aligned with the legs 321 in their collapsed position. The three main assemblies are shown in the collapsed position as the base leg assembly 101, the yoke gimbal assembly 102, and the target support assembly 103. The target supports (furring strips) 104 having been removed. The figure shows the hand carry position 1031 at the balance point on the inverted target support assembly 103. For added convenience, carry strap holes 1011 are located at the bottom side of each of the targets support beams 281 and 291 near their outer ends. Connecting a carry strap 1021 to said holes provides a hands free means of carrying the collapsed articulated target stand.

Figure 11:
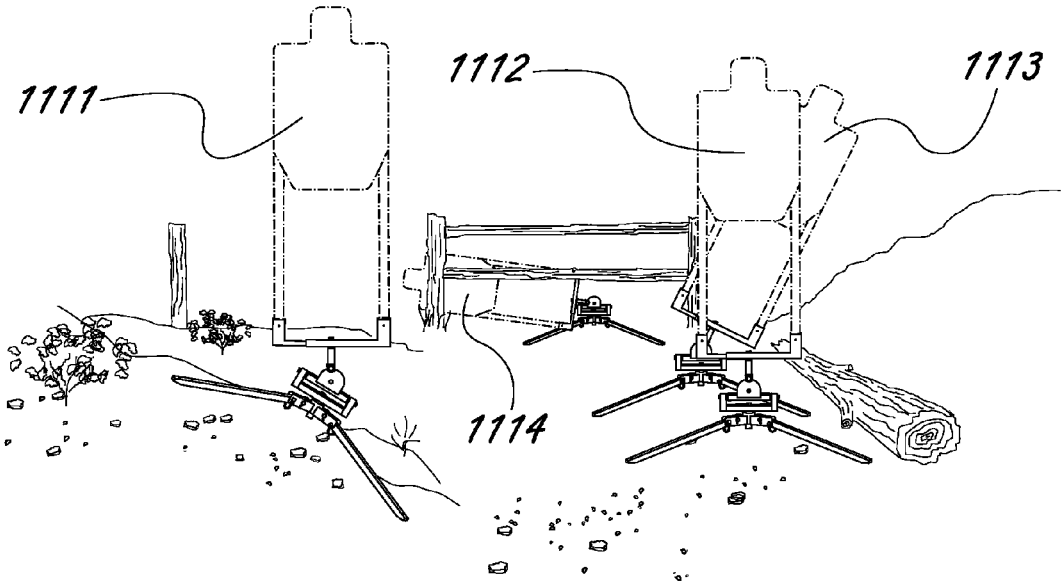
FIG. 11 is a frontal view of several articulated target stands in use over varied terrain, with different target presentations.

FIG. 11 shows the current embodiment of the stand in various use situations. Reference 1111 is the stand adjusted to compensate for uneven ground providing for a normal vertical presentation of the target. References 1112 through 1114 are target presentation one might expect to see in a competitive shooting scenario. Reference 1112 is the stand over even ground adjusted to present a normal vertical presentation, while target 1113 is adjusted for an angled presentation slightly behind target 1112. The splayed three point stance of the stands as they are deployed allows the stands to be placed very close to one another, slipping one stands legs under another. This two target presentation would be a typical hostage type situation where in the objective is to hit the target behind without hitting the target in front. Reference 1114 is a horizontal presentation of the target from low cover, utilizing the ability of the yoke gimbal assembly to angle the target at a steep angle. The wide stance of the target stand base, combined with the low center of gravity of the mass of the stand and the light weight of the target allows such a presentation to be accomplished.

Figure 12:
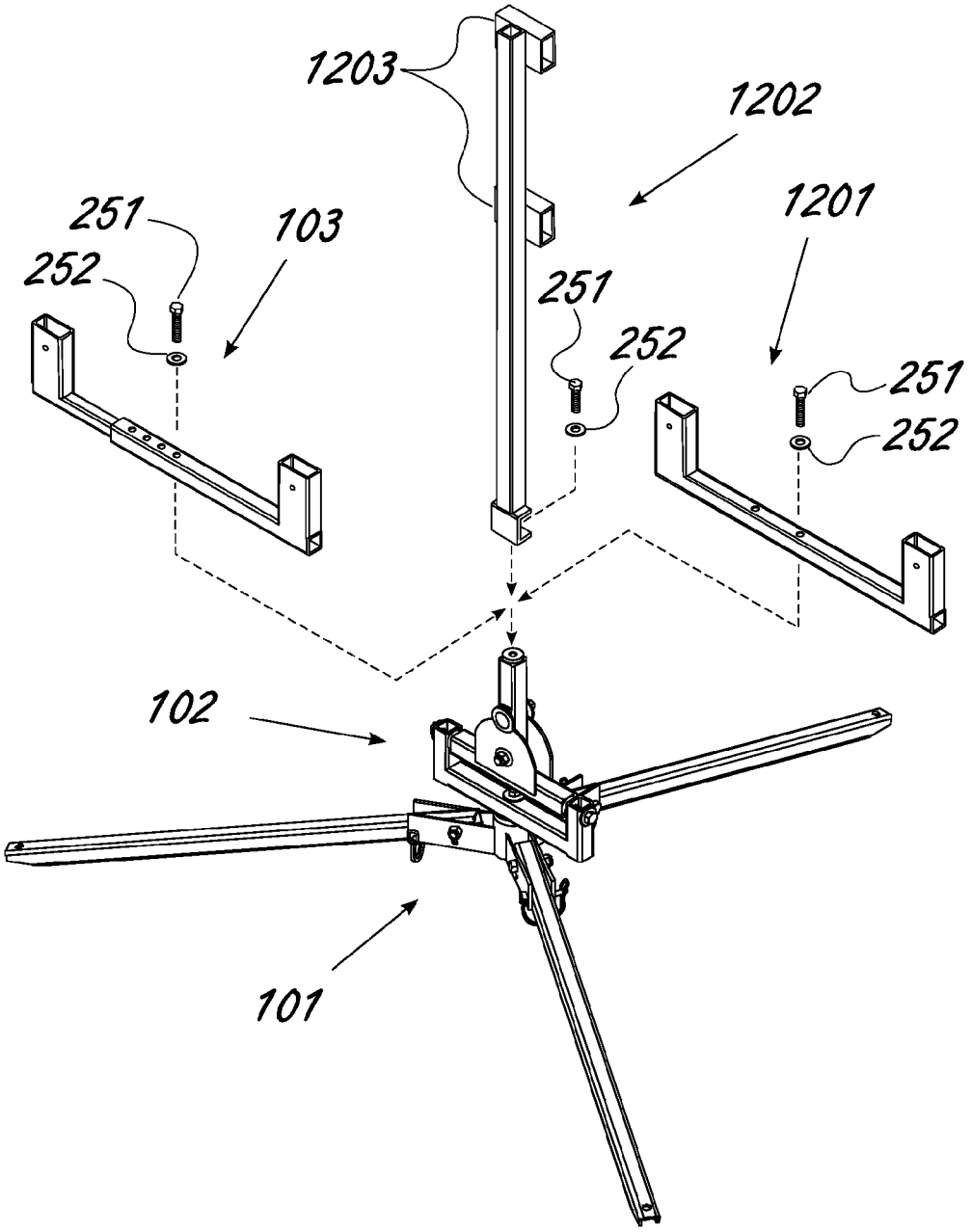
FIG. 12 is an isometric view of the articulated target stand shown with examples of other possible embodiments of the target support assembly as modular components.

FIG. 12 is a partially isometric view of the current embodiment with the leg base assembly 101, the yoke gimbal assembly 102, the target support assembly 103, and examples of alternate embodiments of the target support assembly 1201, wherein the target support assembly is similar to the current described embodiment 103, however it is a fixed length rather than being adjustable, and target support assembly 1202 wherein the target support assembly is a vertical member with horizontal receivers 1203 for inserting target support members. Note that all attach to the yoke gimbal support in the same fashion using a single bolt 251, and washier 252 combinations. This is not an exhaustive representation of the embodiments possible but rather examples showing the modularity of the embodiment described herein.

Advantages

From the descriptions above, the advantages of the embodiments of my articulated target stand with multiple degrees of adjustment become evident. The embodiments address the issues described previously, not only for placement and terrain compensation, but also for unique target presentation. Advantages offered are:

1. Multiple degrees of adjustment are provided to compensate for uneven, rough, and inclined ground surfaces as well as for setting up unique target presentations in competitive shooting scenarios, without the need to alter the terrain.

2. A wide three point stance, with a large diameter footprint, and a low center of gravity combined with a means to rotate, swivel, and angle the presentation of the target, effectively allows the user to change the center of gravity for the stand further compensating for the terrain it is placed on making it more stable than would otherwise be the case.

3. The use of standard furring strips as target support members, of the type commonly used in competitive shooting disciplines, or other user acquired support material, distancing the target from the actual stand itself, and provides a means for fastening those support members to the stand keeping the target in place when unusual target presentations are utilized.

4. A means for adjusting to standard target widths most commonly used in competitive and recreational shooting.

5. Ease in carry and transportation as the stand is collapsible, folding to a balanced carry configuration such that a one handed carry is comfortable, and multiple stands can be carried along with other range gear if a carry strap is utilized.

6. Modular in design allowing for field modification, repair or the addition of user implemented target support attachments substituting for one assembly for another. As an example, if over flat terrain, or terrain compensation is not desired or needed then the yoke gimbal assembly can be removed, and the target stand can be utilized with the target support assembly being mounted directly to the base giving a lower vertical only presentation. Additionally alternate embodiments each assembly can easily be swapped in and out.

CONCLUSIONS, RAMIFICATION AND SCOPE

Accordingly, the reader will see that at least one embodiment of the articulated target stand provides the user with a versatile, compact, steady means by which to deploy a target for recreational and sport shooting in any terrain they may wish to utilize. Rather than being constrained to find the perfect terrain for the target stand, they can now find the terrain situation they desire and with this embodiment for the articulated target stand, they have the target stand that will accommodate the terrain and still provide the target presentation they desire.

While the above description contains many specifics, these should not be construed as limitation on the scope, but rather as an exemplification of one [or several] embodiment(s) thereof. For example while the yoke gimbal assembly (102) offers three degrees of motion for optimum adaptation to the terrain, one or more of these degrees of freedom could be eliminated if that degree of adjustment is not needed for a specific purpose or presentation and the user knows that is not going to change. One extreme, is to stack yoke gimbal assemblies to one another adding many more degrees of adjustment such that a snake like ability is created allowing the target presentation to be wrapped around an obstacle. The other extreme is to remove the yoke gimbal assembly limiting the stand to only one degree of adjustment about the horizontal plane, relying upon level ground for a vertical target presentation.

Another example of an alternate embodiment is to further integrate a different locking mechanism into the pivot points of the stand articulations such as pins, detents, or integrated levers rather than the bolts of the current embodiment. Rather than manually locking the stand's articulations, another alternative embodiment is to motorize the motion of the pivot points, and with an electronic interface sufficient to control the motors, remotely position the target presentation allowing the motors to hold the position, or even animate them for increased difficulty for the user.

Further embodiments for the articulated target stand, may be in the scale of the embodiment. While the current embodiment is illustrated with standard anthropomorphic type targets that are readily available, scaled down special purpose embodiments of the articulated target stand fabricated of a light weight materials, for use with small commercially available non-destructive reactive targets while backpacking can be implemented. The opposite end of this embodiment would be larger transportable embodiments offering the same type of flexibility for ground compensation, yet strengthened for hardened reactive targets. This type of articulated stand embodiment would allow an ad hoc field setup over natural terrain to be implemented for use with larger caliber or heavier weapons.

Because of the modular design of the articulated target stand, the embodiment for the target support assembly (103) provides an additional degree of rotational adjustment with respect to the yoke gimbal assembly when it is attached to the yoke gimbal assemble. It also acts as the interface component between the articulate stand and the target. The only requirements are that the target assembly attaches to the yoke gimbal assembly and that the target support assembly offer some means to attach to the target either directly or indirectly via additional target support elements. Therefore the embodiment of the target support assembly is driven not only by a means needed to connect to the yoke gimbal assembly of the stand but also by the particular embodiment of the target used, while the embodiments of the other assemblies can be essentially unchanged which is an advantage of the modularity.

In the case of the current target stand embodiment, the objective is to support current commonly available cardboard targets used in sport shooting. As such there are several distinct widths available, so the embodiment of the target support assembly incorporates a means for adjusting the width of the assembly while keeping the assembly centered on the mount to the yoke gimbal assembly to match the targets. If only one width of target it to be used then an embodiment with only one fixed width is needed (1201). Another embodiment would be an embodiment to enable a string of targets to be supported between two of the articulated stands. In this case the embodiment of the target support assembly need only be a single vertical element (1202) that provides attachment points along its length and that attaches to the yoke gimbal assembly as previously described. An embodiment of said vertical target support assembly attached to each of two articulated stands, and oriented such that the vertical target support assemblies are vertical, and then attaching stringers with targets between the vertical target support assemblies would accomplish such an objective.

Accordingly, the scope should be determined not by the embodiments(s) illustrated, but by the appended claims and their legal equivalents.

I claim:

1. An articulated adjustable target stand comprising:

a. a base assembly consisting of a plurality of legs, radially symmetrical about a cylinder hub; and b. a three axis yoke gimbal assembly integrating a mounting post extending vertically from the center of the yoke gimbal assembly; and c. means to pivotally couple said base assembly to said yoke gimbal assembly such that the yoke gimbal assembly is selectively rotatable or locked at a predetermined position about the pivotal coupling; and d. a target support assembly; and e. means to pivotally couple said target support assembly to said yoke gimbal mounting post such that the target support assembly is selectively rotatable or locked at a predetermined position about the axis of said yoke gimbal mounting post; and f. means to attach to said target support assembly any expendable target support uprights such as the operator may choose to provide; being commercially available or fabricated; and g. means preventing said expendable target support uprights, as provided by the operator, from separating from said target support assembly regardless of the angle of the target presentation; and h. means to couple said target support assembly to said yoke gimbal mounting post such that the balance point of the target stand is directly below said target support assembly when the target support assembly is gripped by the operator to lift and carry the target stand.

2. The articulated adjustable target stand of claim 1, wherein the base assembly further comprises;

a. a cylinder hub consisting of a short vertically oriented cylindrical member; and b. means for pivotally coupling the upper end of said cylinder hub to the lower end of said yoke gimbal assembly such that the yoke gimbal assembly can be selectively rotatable or locked to a predetermined position about the axis of the cylinder hub; and c. a plurality of three flange plate pairs connected to and disposed about said cylinder hub, with each pair of said plates being vertically oriented to the cylinder hub axis, and each pair of said plate surfaces also being parallel to one another, separated by a predetermined distance; and d. a plurality of three legs placed radially symmetrical about the cylinder hub each being respectively sandwiched between said flange plate pairs; and e. means for pivotally coupling said legs, each between one of a said flange plate pair such that said legs are rotatable 180 degrees from the vertical, away from said cylinder hub axis, continuing through the horizontal on to the vertical; and f. means for selectively freeing and locking said legs into a position wherein the axis of said legs are parallel to the axis of said cylinder hub and is referred to as the first or collapsed leg position or into a position wherein the axis of said leg is depressed slightly below the horizontal such that the ends of said legs create a point contact with the ground thereby supporting said target stand respectively by the three said points and is referred to as the second or deployed leg position.

3. The adjustable articulated target stand according to claim 2 wherein the base assembly further comprises;

a. said cylinder hub integrating a horizontal surface cap on the upper end of the cylinder hub such that the surface is flat and perpendicular to the axis of the cylinder hub, and further integrates a threaded hole in the center of said cylinder hub surface cap such that the axis of the threaded hole is coincident with the axis of the cylinder hub; and b. said flange plate pairs further integrating a single flange pivot hole extending through each of the flange plates such that the holes are perpendicular to the surface of the flange plates, are of identical diameter, and whose axes are coincident between the flange plates; and c. said flange plate pairs further integrating a single first position pin hole placed vertically below said flange pivot holes extending through each of the flange plates such that the first position pin holes are perpendicular to the surface of the flange plates, are of identical diameter, and whose axes are coincident between the flange plates; and d. said flange plate pairs further integrating a single second position pin hole placed radially out from said flange pivot holes and slightly depressed below what would be a horizontal plane through the flange pivot holes, extending through each of the flange plates such that the second position holes are perpendicular to the surface of the flange plates, are of identical diameter, and are the same diameter as said first position pin holes, and whose axes are coincident between said flange plates; and e. said legs further being formed of linear members such that each are respectively of equal length and whose cross section is predetermined by the separation between said flange plate pairs; and f. said legs further integrate a single leg pivot hole near one end such that the leg pivot hole extends completely through the leg, and is perpendicular to the axis of the leg; and g. said legs further integrate one first position leg pin hole located along the same plane as that formed by the axis of said leg and said leg pivot hole, further being located a predetermined distance forward of the leg pivot hole toward the closest distal end of the leg, further being perpendicular to the axis of the leg extending completely through the leg, and are the same diameter as said flange first position pin holes; and h. said legs further integrate one second position leg pin hole located along the same plane as that formed by the axis of said leg and said leg pivot hole, further being located a predetermined distance toward the farthest distal end from the leg pivot hole, further being perpendicular to the axis of the leg extending completely through the leg, and are the same diameter as said flange second position pin holes; and i. a leg pivot bolt disposed respectively through said flange pivot holes aligned with said leg pivot holes such that the leg is further sandwiched between the flange plate pair, further being coupled with a mating lock nut thereby pivotally coupling the leg between a flange plate pair; and j. a leg locking pin releasably disposed respectively though either said flange first position pin holes aligned with said leg first position pin hole or said flange second position pin holes aligned with said leg second position pin hole thereby providing a means for selectively freeing or locking said leg into said first or second leg position.

4. The articulated adjustable target stand of claim 1 wherein the yoke gimbal assembly further comprises;

a. a lower yoke in the form of a squared off "U" shape such that the base of the lower yoke is a horizontal member of predetermined length, and the vertical members of the lower yoke are, parallel to one another, and of identical predetermined lengths; and b. means for pivotally coupling the horizontal member of said lower yoke to the upper surface of said base assembly such that the horizontal member of said lower yoke can selectively rotate or lock to a predetermined position about said pivotal coupling with said base assembly; and c. an upper yoke consisting of a horizontal member whose length is predetermined by the distance between said lower yoke vertical members, and is further integrally sandwiched and centered between the surface of a pair of semicircular plates such that the surface of the plates are parallel to one another and a lower edge of the semicircular plates aligns with the axis of said upper yoke horizontal member; and d. means for pivotally coupling said upper yoke horizontal member between the said lower yoke vertical members such that the upper yoke is sandwiched between said lower yoke vertical members, and can selectively rotate or lock to a predetermined position about a coincident horizontal axis formed between the upper ends of said lower yoke vertical members and along the long axis of the upper yoke horizontal member; and e. further incorporates said yoke gimbal mounting post whose width is further predetermined by the distance between the facing surfaces of said upper yoke semicircular plates and that the said yoke gimbal mounting post can be slidably sandwiched between said upper yoke semicircular plates; and f. means to pivotally couple said yoke gimbal mounting post between said upper yoke semicircular plates such that the yoke gimbal mounting post can selectively rotate and lock to a predetermined position about a horizontal axis formed between centers of said upper yoke semicircular plates; and g. means to pivotally couple the upper end of said yoke gimbal mounting post to said target support assembly such that the target support assembly can selectively rotate or lock to a predetermined position about the long axis of said yoke gimbal mounting post.

5. The articulated adjustable target stand of claim 4 wherein the yoke gimbal assembly further comprises;

a. said lower yoke horizontal member further integrates a lower yoke pivot hole centered between said lower yoke vertical members such that the hole extends completely through said lower yoke horizontal member, and whose axis is parallel with the axes of said lower yoke vertical members; and b. said lower yoke vertical members further integrate pivot holes such that the pivot holes are oriented horizontally, are near the distal ends of the lower yoke vertical members, extend completely through the lower yoke vertical members, and whose axes are coincident, and whose axes are parallel with the axis of said lower yoke horizontal member; and c. said upper yoke horizontal member further integrates threaded holes centered on the distal ends of said upper yoke horizontal member such that the threaded hole axes are coincident with each other and the axis of the said upper yoke horizontal member; and d. said upper yoke semicircular plates further integrate plate pivot holes centered on said upper yoke semicircular plates such that the axes of said pivot holes are coincident with each other and the center of said upper yoke semicircular plates, extending completely through both of the semicircular plates; and e. said yoke gimbal mounting post further incorporates a mounting post pivot hole completely through the mounting post near the lower end of the mounting post such that when the mounting post is slidably inserted between said upper yoke semicircular plates the mounting post pivot hole will align with said plate pivot holes; and f. said yoke gimbal mounting post further incorporates a lock bolt hole, parallel to the mounting post pivot hole at a predetermined distance such that when the mounting post pivot hole is aligned with said plate pivot holes, the lock bolt hole just clears the semicircular radius forming the upper edge of said upper yoke semicircular plates; and g. said yoke gimbal mounting post further integrates a projection from the surface of the mounting post just above said lock bolt hole on opposing sides of the mounting post; further projecting to a predetermined distance from the surface of the mounting post such that the projection on either side of the mounting post does not extend beyond opposing outer surfaces of said upper yoke semicircular plates sandwiching the mounting post; and h. said yoke gimbal mounting post further integrates a threaded hole centered on the upper distal end of the mounting post such that the axis of the threaded hole is aligned with the axis of the mounting post; and i. a lower yoke pivot bolt disposed through said lower yoke horizontal member pivot hole further mating with said base assembly cylinder hub surface cap threaded hole thereby pivotally coupling said yoke gimbal assembly with said base assembly and further providing a means to selectively lock the pivotal relationship between the yoke gimbal assembly and the base assembly by tightening the lower yoke pivot bolt; and j. two upper yoke pivot bolts disposed respectively through said lower yoke vertical member pivot holes mating with said upper yoke horizontal member threaded holes rotationally sandwiching the upper yoke between the ends of the lower yoke vertical members thereby pivotally coupling the upper yoke between the lower yoke vertical members and further providing a means to selectively lock the upper yoke's horizontal rotational position by tightening the upper yoke pivot bolts; and k. an upper yoke plate pivot bolt disposed respectively through said upper yoke plate pivot holes and said mounting post pivot hole such that said yoke gimbal mounting post is sandwiched between said upper yoke semicircular plates and further being coupled with a mating lock nut on the yoke plate pivot bolt thereby pivotally coupling the upper yoke with the yoke gimbal mounting post; and l. a carriage bolt disposed respectively through a washer and said yoke gimbal mounting post lock bolt hole such that said washer straddles both said upper yoke vertical semicircular plate and said yoke gimbal mounting post projection, while the locking surfaces of the carriage bolt engage the upper edge of the upper yoke vertical plate and the lower edge of the yoke gimbal mounting post projection and further being disposed through the yoke gimbal mounting post lock bolt hole, a second washer, and finally a nut thereby providing a means to lock the position of the yoke gimbal mounting post about its rotation on the yoke semicircular plate pivot bolt being accomplished by tightening said nut.

6. The adjustable target stand of claim 1 wherein the target support assembly further comprises;

a. at least two horizontal target support members wherein one member telescopes into the second member; and b. a receiver integrally formed at the non-telescoping distal ends of said horizontal target support members further being cooperatively formed to receive commonly available operator provided expendable target support uprights, thereby providing a means to attach said expendable target uprights to said target support assembly.

7. The adjustable target stand according to claim 6 wherein said target support assembly further comprises;

a. a series of indicia integrated into said telescoping horizontal target support members such that the operator can adjust the distance between said receivers to one of a number of predetermined widths by aligning the indicia; and b. a plurality of cooperatively aligned holes integrated into said telescoping horizontal target support members, such that for each predetermined width adjustment available, a pair of holes between said telescoped members will align in such a way that the aligned holes will be at the center point between said receivers; and c. said receivers being formed of a vertically oriented tubular rectangular cupped shape such that said target support uprights formed of standard commonly available wood furring strips of the type commonly used to support expendable targets can easily be inserted into said receivers thereby providing a means to attach said expendable target uprights to said target support assembly; and further integrated into the walls of said receivers threaded holes whereby mating thumb screws threaded into said threaded holes are used to mechanically retain inserted target support uprights by compressive force exerted upon the support uprights thereby providing a means to fix said expendable target uprights to said target support assembly preventing their separation from said target support assembly regardless of the target presentation; and d. a target support pivot bolt disposed respectively through said cooperatively aligned holes of said telescoping target support horizontal members and further connecting with said yoke gimbal mounting post threaded hole thereby pivotally coupling said target support assembly with said yoke gimbal assembly and further providing a means to selectively lock the pivotal relationship between the yoke gimbal assembly and the target support assembly by tightening the support pivot bolt; and e. a single pair of cooperatively aligned carry holes integrated into said telescoping target support horizontal members at a predetermined location such that when aligned, and the target support assembly is coupled to said yoke gimbal assembly using said target support pivot bolt disposed through said aligned carry holes into said yoke gimbal mounting post threaded hole, and the yoke gimbal mounting post is locked in a position ninety degrees from its vertical, and said legs are locked in the first or collapsed leg position, and the target support assembly is locked in a position such that the target support horizontal members are aligned with said legs, then the target stand is in its collapsed configuration and the target support horizontal members-form a carry handle over the stand center of gravity; and further integrated equidistance about the carry holes along the telescoping target support horizontal members are a plurality of connection points to which a carry strap can be attached keeping the center of gravity balanced between said connection points.

8. The adjustable target stand of claim 1 wherein the target support assembly further comprises;

a. a single horizontal member of predetermined length; and b. a receiver integrally formed at the distal ends of said horizontal member further being cooperatively formed to receive commonly available operator provided expendable target support uprights, thereby providing a means to attach said expendable target uprights to said target support assembly.

9. The adjustable target stand according to claim 8 wherein said target support assembly further comprises;

a. a single target support pivot hole at the center point of said horizontal member between said receivers such that the hole is oriented vertically through the horizontal member; and b. said receivers being formed of a vertically oriented tubular rectangular cupped shape such that said target support uprights formed of standard commonly available wood furring strips of the type commonly used to support expendable targets can easily be inserted into said receivers thereby providing a means to attach said expendable target uprights to said target support assembly; and further integrated into the walls of said receivers threaded holes whereby mating thumb screws threaded into said threaded holes are used to mechanically retain inserted target support uprights by compressive force exerted upon said support uprights thereby providing a means to fix said expendable target uprights to said target support assembly preventing their separation from said target support assembly regardless of the target presentation; and c. a target support pivot bolt disposed through said target support pivot hole and further connecting said yoke gimbal mounting post threaded hole thereby pivotally coupling said target support assembly with said yoke gimbal assembly and further providing a means to selectively lock the pivotal relationship between said yoke gimbal assembly and said target support assembly by tightening said support pivot; and d. a single carry hole integrated into and through said horizontal member at a predetermined location such that when the target support assembly is coupled to said yoke gimbal assembly using said target support bolt disposed through said carry hole and into said yoke gimbal mounting post threaded hole, and the yoke gimbal mounting post is locked in a position ninety degrees from its vertical, and said legs are locked in the first or collapsed leg position, and the target support assembly is locked in a position such that the target support horizontal member is aligned with said legs, then the target stand is in its collapsed configuration and the target support horizontal member forms a carry hand handle over the stand center of gravity; further integrated equidistance about the carry hole along said horizontal member are a plurality of connection points to which a carry strap can be attached keeping the center of gravity balanced between said connection points.

* * * * *